US008480512B2

(12) United States Patent
Oldknow et al.

(10) Patent No.: US 8,480,512 B2
(45) **Date of Patent: *Jul. 9, 2013**

(54) GOLF CLUB HEAD OR OTHER BALL STRIKING DEVICE HAVING FACE INSERT MATERIAL

(75) Inventors: Andrew G. V. Oldknow, Beaverton, OR (US); Adam D. Liber, Portland, OR (US); Robert Boyd, Flower Mound, TX (US)

(73) Assignee: Nike, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/447,497

(22) Filed: Apr. 16, 2012

(65) Prior Publication Data

US 2012/0289358 A1 Nov. 15, 2012

Related U.S. Application Data

(63) Continuation of application No. 12/537,053, filed on Aug. 6, 2009, now Pat. No. 8,157,670.

(51) Int. Cl.
*A63B 53/04* (2006.01)

(52) U.S. Cl.
USPC ..... 473/324; 473/329; 473/342; 473/345; 473/349; 473/350

(58) Field of Classification Search
USPC ..... 473/324–350, 287–292
See application file for complete search history.

(56) References Cited

U.S. PATENT DOCUMENTS

| | | | |
|---|---|---|---|
| 925,389 | A | 6/1909 | Royce |
| 2,846,228 | A | 10/1955 | Reach |
| 3,863,932 | A | 2/1975 | Lezatte |
| 4,438,931 | A | 3/1984 | Motomiya |
| 5,064,197 | A | 11/1991 | Eddy |
| 5,346,213 | A | 9/1994 | Yamada |
| 5,451,058 | A | 9/1995 | Price et al. |
| 5,482,282 | A | 1/1996 | Willis |
| 5,524,331 | A | 6/1996 | Pond |
| 5,586,948 | A | 12/1996 | Mick |

(Continued)

FOREIGN PATENT DOCUMENTS

| | | |
|---|---|---|
| JP | 6182005 | 7/1994 |
| JP | 2001029521 | 2/2001 |
| JP | 20023230692 | 11/2002 |
| JP | 2007029588 | 2/2007 |

OTHER PUBLICATIONS

International Search Report & Written Opinion from PCT Application No. PCT/2010/043855, mailed Dec. 20, 2010.

*Primary Examiner* — Sebastiano Passaniti
(74) *Attorney, Agent, or Firm* — Banner & Witcoff, Ltd.

(57) ABSTRACT

A ball striking device, such as a golf club, includes a head with a face having a ball striking surface configured for striking a ball, a body connected to the face, and a filling material, which may be in the form of an insert, connected to a rear surface of the face. The filling material may fill in a thinned portion of the face, which may form a recess on the rear surface of the face that receives the filling material. The filling material has a density that is lower than the density of the face material. Depending on the size, shape, and location of the filling material, the weight distribution, the moment of inertia, and/or the center of gravity of the face may change.

19 Claims, 18 Drawing Sheets

U.S. PATENT DOCUMENTS

| | | | |
|---|---|---|---|
| 5,697,855 | A | 12/1997 | Aizawa |
| 5,888,148 | A | 3/1999 | Allen |
| 5,967,903 | A | 10/1999 | Cheng |
| 5,993,331 | A | 11/1999 | Shieh |
| 6,200,229 | B1 | 3/2001 | Grace et al. |
| 6,277,033 | B1 | 8/2001 | Krumme et al. |
| 6,592,469 | B2 | 7/2003 | Gilbert |
| 6,602,150 | B1 | 8/2003 | Kosmatka |
| 6,743,117 | B2 | 6/2004 | Gilbert |
| 6,875,124 | B2 | 4/2005 | Gilbert et al. |
| 7,140,974 | B2 | 11/2006 | Chao et al. |
| 7,207,898 | B2 | 4/2007 | Rice et al. |
| 7,341,527 | B1 | 3/2008 | Fisher |
| 7,387,579 | B2 | 6/2008 | Lin et al. |
| 7,393,287 | B2 | 7/2008 | Huang |
| 7,794,333 | B2 | 9/2010 | Wallans et al. |
| 8,157,670 | B2 * | 4/2012 | Oldknow et al. ..... 473/324 |
| 2002/0055393 | A1 | 5/2002 | Reyes et al. |
| 2002/0187851 | A1 | 12/2002 | Chang |
| 2004/0242339 | A1 | 12/2004 | Gilbert et al. |
| 2004/0266545 | A1 | 12/2004 | Gilbert et al. |
| 2005/0037864 | A1 | 2/2005 | Gilbert et al. |
| 2007/0117653 | A1 | 5/2007 | Yoneyama |
| 2008/0004132 | A1 | 1/2008 | Lin et al. |
| 2008/0051220 | A1 | 2/2008 | Soracco et al. |
| 2008/0064523 | A1 | 3/2008 | Chen |
| 2008/0108452 | A1 | 5/2008 | Chiang |
| 2009/0029796 | A1 | 1/2009 | Mergy et al. |
| 2009/0131199 | A1 | 5/2009 | Gilbert et al. |
| 2010/0056296 | A1 | 3/2010 | Kumamoto et al. |

* cited by examiner

GOLF CLUB HEAD OR OTHER BALL STRIKING DEVICE HAVING FACE INSERT MATERIAL

CROSS REFERENCE TO RELATED APPLICATION

This application is a continuation of co-pending U.S. patent application Ser. No. 12/537,053, filed Aug. 6, 2009, which is incorporated herein by reference in its entirety and made part hereof.

TECHNICAL FIELD

The invention relates generally to ball striking devices, such as golf club heads, having a filling material or insert on the face. Certain aspects of this invention relate to golf club heads having a thinned portion or recessed area on the rear surface of the ball striking face, which is filled in with a lower-density material.

BACKGROUND

Golf is enjoyed by a wide variety of players—players of different genders, and players of dramatically different ages and skill levels. Golf is somewhat unique in the sporting world in that such diverse collections of players can play together in golf outings or events, even in direct competition with one another (e.g., using handicapped scoring, different tee boxes, etc.), and still enjoy the golf outing or competition. These factors, together with increased golf programming on television (e.g., golf tournaments, golf news, golf history, and/or other golf programming) and the rise of well known golf superstars, at least in part, have increased golfs popularity in recent years, both in the United States and across the world.

Golfers at all skill levels seek to improve their performance, lower their golf scores, and reach that next performance "level." Manufacturers of all types of golf equipment have responded to these demands, and recent years have seen dramatic changes and improvements in golf equipment. For example, a wide range of different golf ball models now are available, with some balls designed to fly farther and straighter, provide higher or flatter trajectory, provide more spin, control, and feel (particularly around the greens), etc.

Being the sole instrument that sets a golf ball in motion during play, the golf club also has been the subject of much technological research and advancement in recent years. For example, the market has seen improvements in golf club heads, shafts, and grips in recent years. Additionally, other technological advancements have been made in an effort to better match the various elements of the golf club and characteristics of a golf ball to a particular user's swing features or characteristics (e.g., club fitting technology, ball launch angle measurement technology, etc.).

Despite the various technological improvements, golf remains a difficult game to play at a high level. For a golf ball to reliably fly straight and in the desired direction, a golf club must meet the golf ball square (or substantially square) to the desired target path. Moreover, the golf club must meet the golf ball at or close to a desired location on the club head face (i.e., on or near a "desired" or "optimal" ball contact location) to reliably fly straight, in the desired direction, and for a desired distance. Off-center hits may tend to "twist" the club face when it contacts the ball, thereby sending the ball in the wrong direction, imparting undesired hook or slice spin, and/or robbing the shot of distance. Club face/ball contact that deviates from squared contact and/or is located away from the club's desired ball contact location, even by a relatively minor amount, also can launch the golf ball in the wrong direction, often with undesired hook or slice spin, and/or can rob the shot of distance. Accordingly, club head features that can help a user keep the club face square with the ball would tend to help the ball fly straighter and truer, in the desired direction, and often with improved and/or reliable distance.

Various golf club heads have been designed to improve a golfer's accuracy by assisting the golfer in squaring the club head face at impact with a golf ball. A number of golf club heads reposition the weight of the golf club head in order to alter the location of the club head's center of gravity. The location of the center of gravity of the golf club head is one factor that determines whether a golf ball is propelled in the intended direction. When the center of gravity is positioned behind the point of engagement on the contact surface, the golf ball follows a generally straight route. When the center of gravity is spaced to a side of the point of engagement, however, the golf ball may fly in an unintended direction and/or may follow a route that curves left or right, ball flights that are often referred to as "pulls," "pushes," "draws," "fades," "hooks," or "slices". Similarly, when the center of gravity is spaced above or below the point of engagement, the route of the golf ball may exhibit more boring or climbing trajectories, respectively. In some circumstances, it may be desirable to raise or lower the center of gravity of a club head in order to achieve these and other ball flight characteristics.

The degree of twisting of the club head upon off-center impacts can also be dependent upon the moment of inertia of the club head. Generally, a higher moment of inertia results in less twisting of the club head on impact. The moment of inertia can be increased by distributing the weight of the club head proportionally more toward the edges of the head and away from the center.

Many off-center golf hits are caused by common errors in swinging the golf club that are committed repeatedly by the golfer, and which may be similarly committed by many other golfers. As a result, patterns can often be detected, where a large percentage of off-center hits occur in certain areas of the club face. For example, one such pattern that has been detected is that many high handicap golfers tend to hit the ball on the low-heel area of the club face and/or on the high-toe area of the club face. Other golfers may tend to miss in other areas of the club face. Because golf clubs are typically designed to contact the ball at or around the center of the face, such off-center hits may result in less energy being transferred to the ball, decreasing the distance of the shot. The energy or velocity transferred to the ball by a golf club also may be related, at least in part, to the flexibility of the club face at the point of contact, and can be expressed using a measurement called "coefficient of restitution" (or "COR"). The maximum COR for golf club heads is currently limited by the USGA at 0.83. Also, as described above, the direction of ball flight and the degree of twisting of the club head during impact may also be related, at least in part, to the moment of inertia of the club head and the location of the center of gravity of the club head with relation to the point of impact. The energy or velocity transferred to the ball by the golf club may also be related to the moment of inertia and/or the location of the center of gravity of the club head.

The distance and direction of ball flight can also be significantly affected by the spin imparted to the ball by the impact with the club head. While the ball is in the air, aerodynamic forces caused by the speed and direction of ball spin can cause the trajectory of the ball to be higher or lower, or to curve, and create "pulls," "pushes," "draws," "fades," "hooks," "slices,"

etc. Additionally, the spin of the ball can change the behavior of the ball as it rolls and bounces after impact with the ground. For example, a high degree of backspin can cause the ball to slow, stop, or even roll backward upon impact, and conversely, topspin or lesser degrees of backspin will cause the ball to travel a greater distance after impact with the ground. Various speeds and directions of spin on the ball can be a product of many factors, including the point of impact, the direction of the club head upon impact, the degree of twisting of the club head upon impact, and the location of the center of gravity of the club head.

Accordingly, a need exists to customize or adjust the moment of inertia and/or the location of the center of gravity of a golf club face to provide maximum energy transfer and minimum twisting for impacts in the areas of the face where off-center hits tend to occur most, as well as to provide desired ball flight characteristics after impact.

BRIEF SUMMARY

The following presents a general summary of aspects of the invention in order to provide a basic understanding of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of the invention relate to ball striking devices, such as golf clubs, with a head that includes a face configured for striking a ball and a body connected to the face, the body being adapted for connection of a shaft thereto. Various example structures of heads described herein include a filling material, which may be in the form of an insert, connected to the rear surface of the face. The filling material may fill in a recess on the rear surface of the face, formed by a thinned portion of the face. The filling material may also be in the form of an insert. Further, the filling material has a density that is lower than the density of the face material.

According to one aspect, the material of the face is a metallic material and the filling material is a polymer-containing material. In one embodiment, the filling material is a composite material, containing a polymer and a fiber.

According to another aspect, the insert or filling material is substantially flush with the rear surface of the face. In other embodiments, the exposed surface of the insert or filling material may be higher or lower than the rear surface of the face.

According to another aspect, the thickness of the insert and the depth of the recess are tapered, increasing from the center of the face toward the outer edge of the face. In one embodiment, the thickness of the insert and the depth of the recess are tapered in two directions, such that the thickness of the insert and the depth of the recess increase in a vertical direction, defined from a bottom edge of the face toward a top edge of the face and the thickness of the insert and the depth of the recess decrease in a horizontal direction, defined from one lateral edge of the face toward the opposite lateral edge.

According to another aspect, the widths of the recess and the insert are tapered, such that they increase from the center of the face toward the outer edges.

According to another aspect, the center of gravity of the insert is vertically offset in one direction from a geometric center of the face, and the center of gravity of the face is vertically offset in the opposite direction from the geometric center of the face.

According to a further aspect, the face conceptually contains a top portion and a bottom portion of generally equal area, and a greater proportion of the insert is located on one of the top portion and the bottom portion compared to the other of the top portion and the bottom portion. Each of the top portion and the bottom portion has a weight distribution that is inversely related to a proportion of the insert located in each respective portion.

Additional aspects of the invention relate to a golf club head that includes a face having a ball striking surface configured for striking a ball, and a body connected to the face. The face is comprised of a first material and has a thinned portion, where the thickness of the first material is smallest at the thinned portion. The head further includes a second material connected to the rear surface of the face and filling the thinned portion, where the second material has a density that is lower than the density of the first material. The thinned portion may form a recess on the rear surface of the face, and the second material may form an insert received in the recess, as described above.

Other aspects of this invention relate to face members for use in a ball striking device, including a face, a wall extending rearward from an outer periphery of the face, an insert connected to the face, as described above. The outer surface of the face is configured for striking a ball, and a rear surface is located rearward and opposite of the outer surface. A recess is formed in the rear surface, and the insert is received within the recess.

Further aspects of the invention relate to methods that can be used for manufacturing or customizing a golf club head, which is provided with a face configured for striking a ball with an outer surface thereof and a body connected to the face. The method includes providing a face having an outer surface configured for striking a ball and a rear surface opposite the outer surface, the rear surface having a recess, and filling the recess with an insert material. The insert material has a density that is lower than the density of the face material. The method may also include removing the insert or material and interchanging it with another insert or material having at least one different property.

Still further aspects of the invention relate to golf clubs that include a golf club head as described above and a shaft connected to the head.

Other features and advantages of the invention will be apparent from the following description taken in conjunction with the attached drawings.

BRIEF DESCRIPTION OF THE DRAWINGS

To allow for a more full understanding of the present invention, it will now be described by way of example, with reference to the accompanying drawings in which.

DETAILED DESCRIPTION

Figure 1:
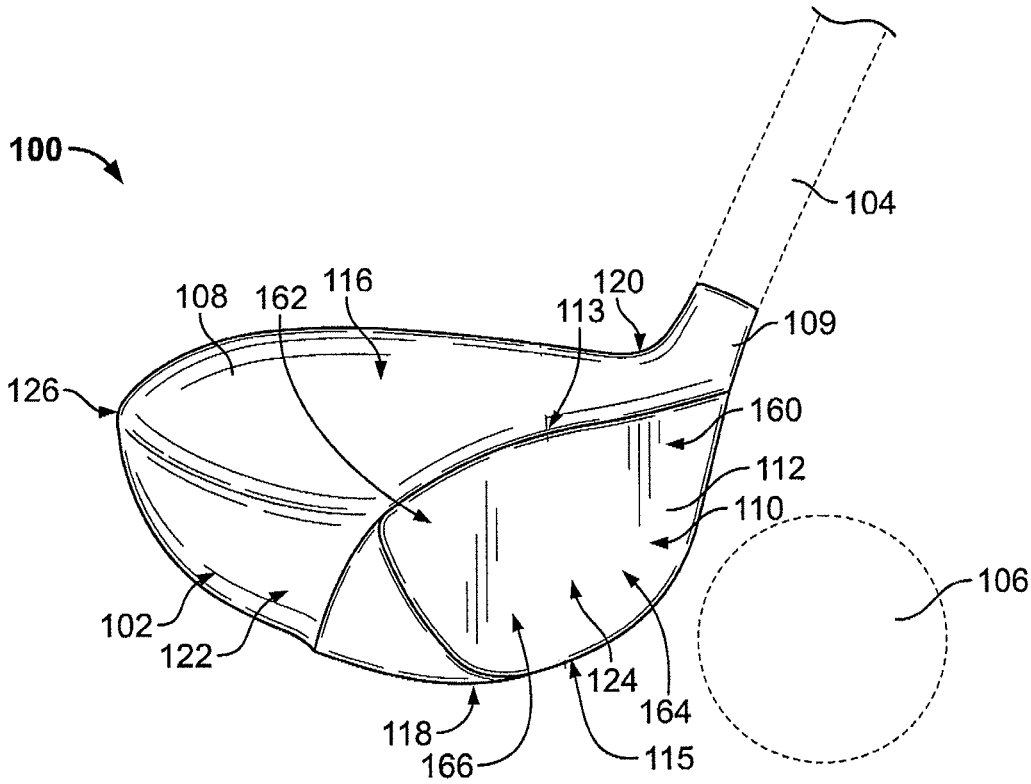
FIG. 1 is a perspective view of an illustrative embodiment of a head of a ball striking device according to the present invention, shown with a ball.

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this invention. Also, the reader is advised that the attached drawings are not necessarily drawn to scale.

The following terms are used in this specification, and unless otherwise noted or clear from the context, these terms have the meanings provided below.

"Ball striking device" means any device constructed and designed to strike a ball or other similar objects (such as a hockey puck). In addition to generically encompassing "ball striking heads," which are described in more detail below, examples of "ball striking devices" include, but are not limited to: golf clubs, putters, croquet mallets, polo mallets, baseball or softball bats, cricket bats, tennis rackets, badminton rackets, field hockey sticks, ice hockey sticks, and the like.

"Ball striking head" means the portion of a "ball striking device" that includes and is located immediately adjacent (optionally surrounding) the portion of the ball striking device designed to contact the ball (or other object) in use. In some examples, such as many golf clubs and putters, the ball striking head may be a separate and independent entity from any shaft or handle member, and it may be attached to the shaft or handle in some manner.

The terms "shaft" and "handle" are used synonymously and interchangeably in this specification, and they include the portion of a ball striking device (if any) that the user holds during a swing of a ball striking device.

"Integral joining technique" means a technique for joining two pieces so that the two pieces effectively become a single, integral piece, including, but not limited to, irreversible joining techniques, such as adhesively joining, cementing, welding, brazing, soldering, or the like, where separation of the joined pieces cannot be accomplished without structural damage thereto.

"Substantially flush" means that a surface of one article is level and aligned with the surface of an adjacent article, such that the two surfaces form a substantially flat single surface, within a tolerance of +/− 0.005 inches.

The "vertical direction" on a ball striking face can be conceptually defined as extending from the horizontal centerline of the face to the top or bottom edge of the face and/or between the bottom edge and the top edge of the face.

The "horizontal direction" on a ball striking face can be conceptually defined as extending from the vertical centerline of the face to one of the lateral edges of the face and/or between opposite lateral edges of the face.

In general, aspects of this invention relate to ball striking devices, such as golf club heads, golf clubs, putter heads, putters, and the like. Such ball striking devices, according to at least some examples of the invention, may include a ball striking head and a ball striking surface. In the case of a golf club, the ball striking surface is a substantially flat surface on one face of the ball striking head. Some more specific aspects of this invention relate to wood-type golf clubs and golf club heads, including drivers, fairway woods, wood-type hybrid clubs, and the like, although aspects of this invention also may be practiced on irons, iron-type hybrid clubs, and the like.

According to various aspects of this invention, the ball striking device may be formed of one or more of a variety of materials, such as metals (including metal alloys), ceramics, polymers, composites (including fiber-reinforced composites), and wood, and may be formed in one of a variety of configurations, without departing from the scope of the invention. In one illustrative embodiment, some or all components of the head, including the face and at least a portion of the body of the head, are made of metal. It is understood that the head may contain components made of several different materials, including carbon-fiber and other components. Additionally, the components may be formed by various forming methods. For example, metal components (such as titanium, aluminum, titanium alloys, aluminum alloys, steels (including stainless steels), and the like) may be formed by forging, molding, casting, stamping, machining, and/or other known techniques. In another example, composite components, such as carbon fiber-polymer composites, can be manufactured by a variety of composite processing techniques, such as prepreg processing, powder-based techniques, mold infiltration, and/or other known techniques.

The various figures in this application illustrate examples of ball striking devices according to this invention. When the same reference number appears in more than one drawing, that reference number is used consistently in this specification and the drawings to refer to the same or similar parts throughout.

At least some examples of ball striking devices according to this invention relate to golf club head structures, including heads for wood-type golf clubs, such as drivers, as well as long iron clubs (e.g., driving irons, zero irons through five irons, and hybrid type golf clubs), short iron clubs (e.g., six irons through pitching wedges, as well as sand wedges, lob wedges, gap wedges, and/or other wedges), and putters. Such devices may include a one-piece construction or a multiple-piece construction. Example structures of ball striking devices according to this invention will be described in detail below in conjunction with FIGS. 1-2, which illustrates an example of a ball striking device 100 in the form of a golf driver, and FIGS. 22-23, which illustrates an example of a ball striking device 200 in the form of an iron-type golf club.

Figure 2:
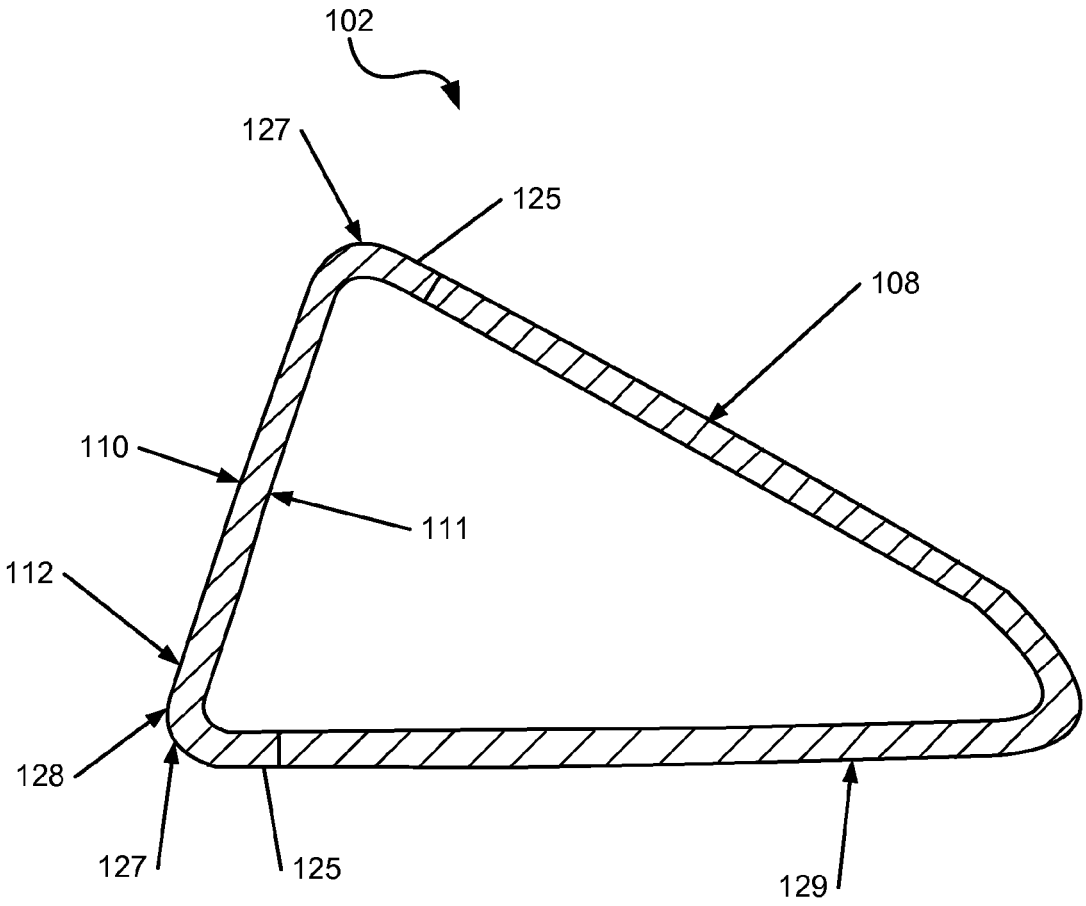
FIG. 2 is a cross-sectional view of the head of FIG. 1.

FIGS. 1 and 2 illustrate a ball striking device 100 in the form of a golf driver, in accordance with at least some examples of this invention. As shown in FIG. 1, the ball striking device 100 includes a ball striking head 102 and a shaft 104 connected to the ball striking head 102 and extending therefrom. A ball 106 in use is also schematically shown in FIG. 1, in a position to be struck by the ball striking device 100. The ball striking head 102 of the ball striking device 100 of FIG. 1 has a face 112 connected to a body 108, with a hosel 109 extending therefrom. Any desired hosel and/or head/shaft interconnection structure may be used without departing from this invention, including conventional hosel and/or head/shaft interconnection structures as are known and used in the art. For reference, the head 102 generally has a top 116, a bottom or sole 118, a heel 120 proximate the hosel 109, a toe 122 distal from the hosel 109, a front 124, and a back or rear 126. The shape and design of the head 102 may be partially dictated by the intended use of the device 100. In the club 100 shown in FIG. 1, the head 102 has a relatively large volume, as the club 100 is designed for use as a driver or wood-type club, intended to hit the ball accurately over long distances. In other applications, such as for a different type of golf club, the head may be designed to have different dimensions and configurations. When configured as a driver, the club head may have a volume of at least 400 cc, and in some structures, at least 450 cc, or even at least 460 cc. Other appropriate sizes for other club heads may be readily determined by those skilled in the art. It is understood that in some embodiments, the face 112 and the body 108 may be part of a unitary structure, such as in a head 102 that has no inner cavity. In such an embodiment, the ball striking surface 110 and the rear surface 111 of the face 112 may be surfaces formed on the body 108 of the club head 102.

In the illustrative embodiment illustrated in FIGS. 1 and 2, the head 102 has a hollow structure defining an inner cavity (e.g., defined by the face 112 and the body 108). Thus, the head 102 has a plurality of inner surfaces defined therein. In one embodiment, the hollow center cavity may be filled with air. However, in other embodiments, the head 102 could be filled with another material, such as foam. In still further embodiments, the solid materials of the head may occupy a greater proportion of the volume, and the head may have a smaller cavity or no inner cavity at all. It is understood that the inner cavity may not be completely enclosed in some embodiments.

The face 112 is located at the front 124 of the head 102, and has a ball striking surface 110 located thereon and a rear or inner surface 111 opposite the ball striking surface 110. The ball striking surface 110 is typically an outer surface of the face 112 configured to face a ball 106 in use, and is adapted to strike the ball 106 when the device 100 is set in motion, such as by swinging. As shown, the ball striking surface 110 is relatively flat, occupying most of the face 112. For reference purposes, the portion of the face 112 nearest the top face edge 113 and the heel 120 of the head 102 is referred to as the "high-heel area" 160; the portion of the face 112 nearest the top face edge 113 and toe 122 of the head 102 is referred to as the "high-toe area" 162; the portion of the face 112 nearest the bottom face edge 115 and heel 120 of the head 102 is referred to as the "low-heel area" 164; and the portion of the face 112 nearest the bottom face edge 115 and toe 122 of the head 102 is referred to as the "low-toe area" 166. Conceptually, these areas 160-166 may be recognized and referred to as quadrants of substantially equal size (and/or quadrants extending from a geometric center of the face 112), though not necessarily with symmetrical dimensions. The face 112 may include some curvature in the top to bottom and/or heel to toe directions (e.g., bulge and roll characteristics), as is known and is conventional in the art. In other embodiments, the surface 110 may occupy a different proportion of the face 112, or the body 108 may have multiple ball striking surfaces 110 thereon. In the illustrative embodiment shown in FIG. 1, the ball striking surface 110 is inclined slightly (i.e., at a loft angle), to give the ball 106 slight lift and spin when struck. In other illustrative embodiments, the ball striking surface 110 may have a different incline or loft angle, to affect the trajectory of the ball 106. Additionally, the face 112 may have a variable thickness and/or may have one or more internal or external inserts in some embodiments.

It is understood that the face 112, the body 108, and/or the hosel 109 can be formed as a single piece or as separate pieces that are joined together. In the illustrative embodiment shown in FIG. 2, the face 112 is formed as part of a face frame member 128, with a wall or walls 125 extending rearward from the edges 127 of the face 112. This configuration is also known as a cup face structure. The body 108 can be formed as a separate piece or pieces joined to the walls 125 of the face frame member 128. In the illustrative embodiment shown in FIG. 2, the body 108 is partially formed by a backbody member 129, which may be a single piece or multiple pieces. The walls 125 of the face frame member 128 combine with the backbody member 129 to form the body 108 of the head 102. These pieces may be connected by an integral joining technique, such as welding, cementing, or adhesively joining. Other known techniques for joining these parts can be used as well, including many mechanical joining techniques, including releasable mechanical engagement techniques. If desired, the hosel 109 may be integrally formed as part of the face frame member 128. Further, a gasket (not shown) may be included between the face frame member 128 and the backbody member 129.

Figure 22:
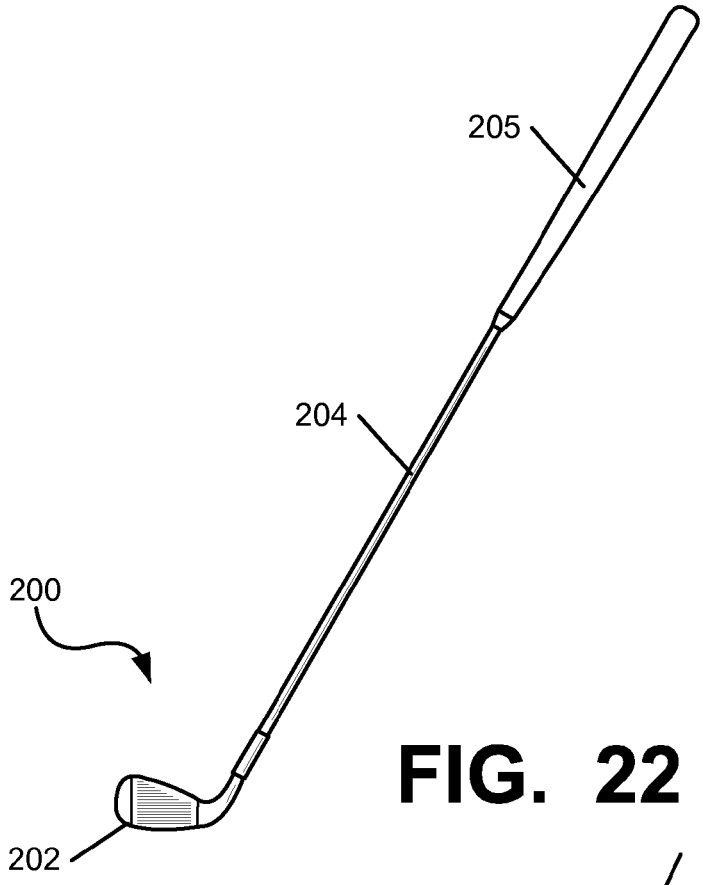
FIG. 22 is a front view of an illustrative embodiment of an iron-type ball striking device which can be used according to aspects of the present invention.
Figure 23:
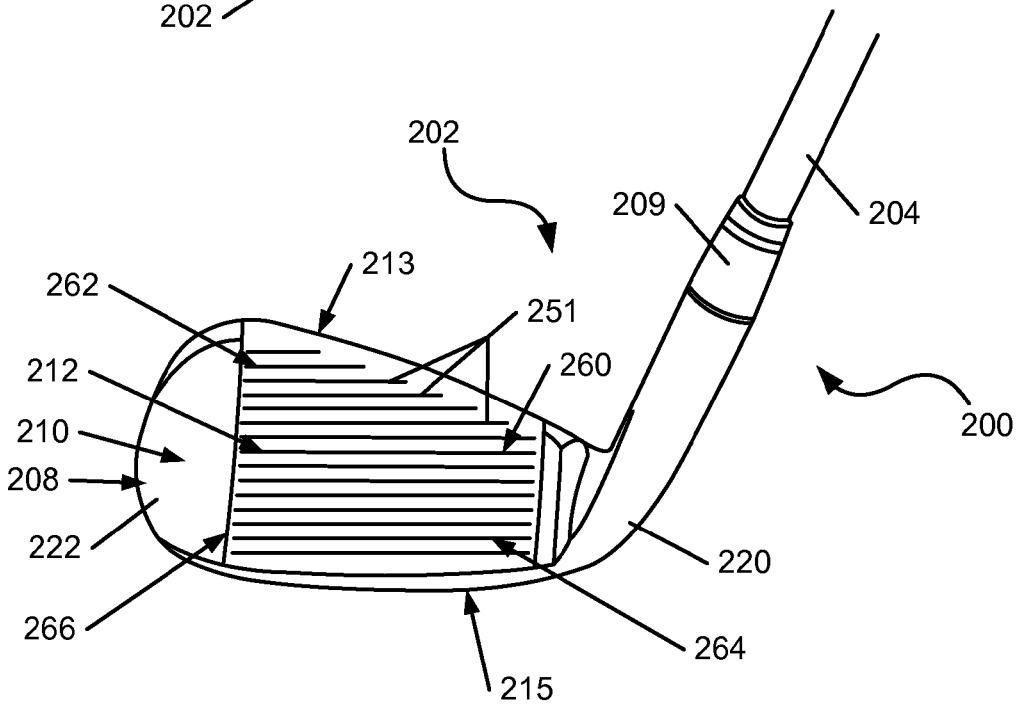
FIG. 23 is a cross-sectional view of the head of FIG. 22.

FIGS. 22-23 illustrate a ball striking device 200 in the form of a golf iron, in accordance with at least some examples of this invention. Many common components between the ball striking device 100 of FIGS. 1 and 2 and the ball striking device 200 of FIGS. 22-23 are referred to using similar reference numerals in the description that follows, using the "200" series of reference numerals. The ball striking device 200 includes a shaft 204 and a golf club head 202 attached to the shaft 204. The golf club head 202 of FIGS. 22-23 may be representative of any iron or hybrid type golf club head in accordance with examples of the present invention.

Figure 25:
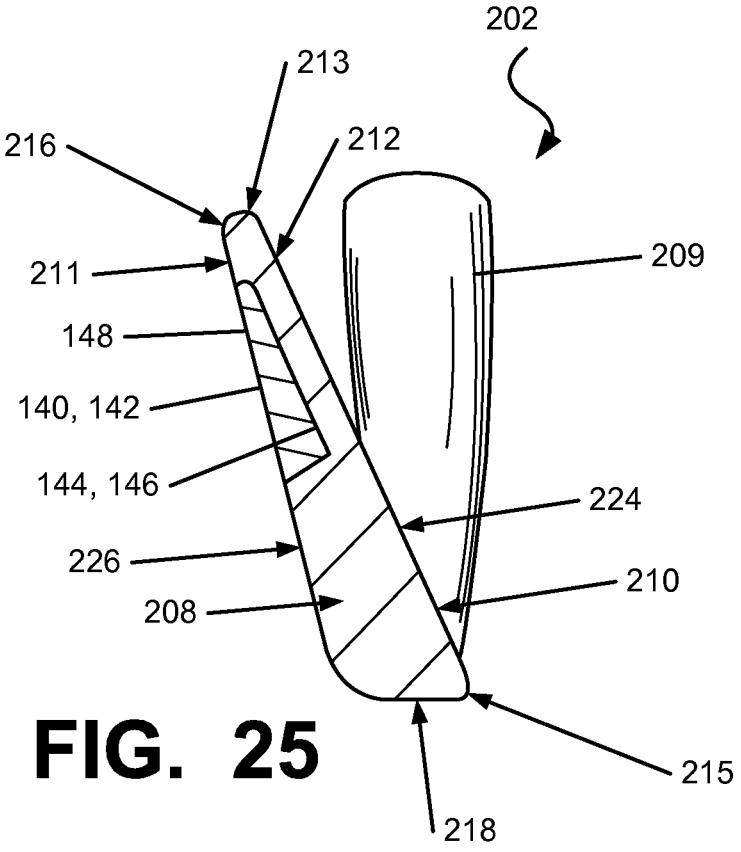
FIG. 25 is a cross-sectional view of the face of FIG. 24, taken along lines 25-25 of FIG. 24.

As shown in FIGS. 22-23, the golf club head 202 includes a body member 208 having a face 212 and a hosel 209 extending from the body 208 for attachment of the shaft 204. For reference, the head 202 generally has a top 216, a bottom or sole 218, a heel 220 proximate the hosel 209, and a toe 222 distal from the hosel 209, as well as a front 224 and a back or rear 226 as shown in FIG. 25. In the embodiment shown, the face 212 extends upward from the sole 218 of the head 202. The shape and design of the head 202 may be partially dictated by the intended use of the device 200. The heel portion 220 is attached to and/or extends from a hosel 209 (e.g., as a unitary or integral one piece construction, as separate connected elements, etc.).

The face 212 is located at the front 224 of the head 202, and has a ball striking surface 210 located thereon and a rear or inner surface 211 (See FIGS. 24-25) opposite the ball striking surface 210. It is understood that in some embodiments of an iron-type golf club 200, the rear surface 211 of the face 212 may be a surface of the body 208, such as when the head 202 has no internal cavity, for example, as illustrated in FIGS. 24-29. The ball striking surface 210 is typically an outer surface of the face 212 configured to face a ball (not shown) in use, and is adapted to strike the ball when the device 200 is set in motion, such as by swinging. As shown, the ball striking surface 210 is relatively flat, occupying most of the face 212. The ball striking surface 210 may include grooves 251 (e.g., generally horizontal grooves 251 extending across the face 212 in the illustrated example) for the removal of water and grass from the face 212 during a ball strike. Of course, any number of grooves, desired groove patterns, and/or groove constructions may be provided (or even no groove pattern, if desired), including conventional groove patterns and/or constructions, without departing from this invention.

For reference purposes, the portion of the face 212 nearest the top face edge 213 and the heel 220 of the head 202 is referred to as the "high-heel area" 260; the portion of the face 212 nearest the top face edge 213 and toe 222 of the head 202 is referred to as the "high-toe area" 262; the portion of the face 212 nearest the bottom face edge 215 and heel 220 of the head 202 is referred to as the "low-heel area" 264; and the portion of the face 212 nearest the bottom face edge 215 and toe 222 of the head 202 is referred to as the "low-toe area" 266. Conceptually, these areas 260-266 may be recognized and referred to as quadrants of substantially equal size (and/or quadrants extending from a geometric center of the face 212), though not necessarily with symmetrical dimensions. The face 212 may include some curvature in the top to bottom and/or heel to toe directions (e.g., bulge and roll characteristics), as is known and is conventional in the art. In other embodiments, the surface 210 may occupy a different proportion of the face 212, or the body 208 may have multiple ball striking surfaces 210 thereon. In the illustrative embodiment shown in FIGS. 22-23, the ball striking surface 210 is inclined (i.e., at a loft angle), to give the ball an appreciable degree of lift and spin when struck. In other illustrative embodiments, the ball striking surface 210 may have a different incline or loft angle, to affect the trajectory of the ball. Additionally, the face 212 may have a variable thickness and/or may have one or more internal or external inserts in some embodiments. It is understood that the face 212, the body 208, and/or the hosel 209 can be formed as a single piece or as separate pieces that are joined together.

The body member 208 of the golf club head 202 may be constructed from a wide variety of different materials, including materials conventionally known and used in the art, such as steel, titanium, aluminum, tungsten, graphite, polymers, or composites, or combinations thereof. Also, if desired, the club head 202 may be made from any number of pieces (e.g., having a separate face plate, etc.) and/or by any construction technique, including, for example, casting, forging, welding, and/or other methods known and used in the art. It is understood that in some embodiments, the face 212 and the body 208 may be part of a unitary structure, such as in a head 202 that has no inner cavity. In such an embodiment, the ball striking surface 210 and the rear surface 211 of the face 212 may be surfaces formed on the body 208 of the club head 202.

The ball striking device 100, 200 may include a shaft 104, 204 connected to or otherwise engaged with the ball striking head 102, 202, as shown schematically in FIGS. 1 and 22-23. The shaft 104, 204 is adapted to be gripped by a user to swing the ball striking device 100, 200 to strike the ball 106. The shaft 104, 204 can be formed as a separate piece connected to the head 102, 202, such as by connecting to the hosel 109, 209, as shown in FIGS. 1 and 22-23. In other illustrative embodiments, at least a portion of the shaft 104, 204 may be an integral piece with the head 102, 202, and/or the head 102, 202 may not contain a hosel 109, 209 or may contain an internal hosel structure. Still further embodiments are contemplated without departing from the scope of the invention. The shaft 104, 204 may be constructed from one or more of a variety of materials, including metals, ceramics, polymers, composites, or wood. In some illustrative embodiments, the shaft 104, 204, or at least portions thereof, may be constructed of a metal, such as stainless steel or titanium, or a composite, such as a carbon/graphite fiber-polymer composite. However, it is contemplated that the shaft 104, 204 may be constructed of different materials without departing from the scope of the invention, including conventional materials that are known and used in the art. A grip element 205 may be positioned on the shaft 104, 204 to provide a golfer with a slip resistant surface with which to grasp golf club shaft 104, 204, as shown in FIG. 22. The grip element 205 may be attached to the shaft 104, 204 in any desired manner, including in conventional manners known and used in the art (e.g., via adhesives or cements, threads or other mechanical connectors, swedging/swaging, etc.).

In general, the head 102, 202 of the ball striking device 100, 200 has a face 112, 212 that has a thinned portion 144 forming a recess 146 on the rear surface 111, 211 of the face 112, 212, with a filling material 140 at least partially filling the recess 146 or thinned portion 144. The filling material 140 may take the form of an insert 142. Various embodiments are described herein with respect to wood-type heads 102, such as the head 102 illustrated in FIGS. 1 and 2 and iron-type heads 202, such as the head 202 illustrated in FIGS. 22-23. It is understood that in various embodiments, the face 112, 212 may include more than one recess 146 or thinned portion 144 containing more than one insert 142 or other filling material 140. In other embodiments, thinned portions 144, recesses 146, filling materials 140 and/or inserts 142 described herein may have any desired shape, although generally the inserts 142 or filling materials 140 may be shaped and otherwise configured to fit within the appropriate thinned portion 144 or recess 146 in a complementary manner, as in the examples shown in FIGS. 18-21 and discussed below.

In one embodiment, the filling material 140 has a lower density than the material of the face 112, 212. It is understood that the density of the material can be influenced by the natural density properties of the bulk insert material, as well as other factors, such as the porosity of the material. By using a filling material 140 having a different density than the face 112, 212, the weight distribution, center of gravity, and/or moment of inertia of the head 102, 202 and face 112, 212 can be adjusted. Additionally, a filling material 140 having a different density than the face material can be used to shift the center of gravity of the face 112, 212 toward a desired area of the face 112, 212, such as an area where missed hits frequently occur. When a filling material 140 having a low density is used, the weight distribution of the face 112, 212 is generally shifted away from the areas of the face 112, 212 where the filling material 140 is located. Likewise, a low density filling material 140 can be used to shift the center of gravity away from the area where the filling material 140 is located, such as by using an insert that is positioned asymmetrically with respect to the geometric center of the face 112, 212. For example, when a low-density filling material 140 is predominately located toward the heel 120, 220 of the face 112, 212, the weight of the face is distributed more toward the toe 122, 222, and the center of gravity is also shifted toward the toe 122, 222. As another example, when a low-density filling material 140 is predominately located toward the top edge 113, 213 of the face 112, 212, the weight of the face 112, 212 is distributed more toward the bottom edge 115, 215, and the center of gravity is also shifted lower on the face 112, 212. It is understood that many methods exist for calculating the density of the filling material 140 or insert 142, and in one embodiment, the density is calculated as an average density (e.g. total weight or mass divided by total volume).

Viewed another way, when a low-density filling material 140 occupies an area of the face 112, 212, the weight of the face 112, 212 is disproportionately distributed toward areas of the face 112, 212 not occupied by the insert 140. In some circumstances, the center of gravity of the filling material 140 may be located in one direction from the geometric center of the face 112, 212, and the center of gravity of the face 112, 212 may be shifted in the opposite direction. For example, in one embodiment, at least one quadrant of the face 112, 212 contains a greater proportion of the filling material 140, compared to at least one other quadrant, and each quadrant has a relative weight distribution that is inversely related to the proportion of the filling material 140 located in the respective quadrant. In another embodiment, the face 112, 212 includes a top portion 150 and a bottom portion 152 of equal area (shown in FIGS. 3 and 24), and a greater proportion of the filling material 140 is located in one of the portions 150, 152, compared to the other. In this example, each of the portions 150, 152 has a weight distribution that is inversely related to a proportion of the insert located in each respective portion.

The material of the insert can be selected based on density and/or any other property, and may be a metal (including metal alloys), a ceramic, a polymer, a composite (including fiber-reinforced composites), wood, or any other suitable material. Any other material having desired density and physical properties can be used in various other embodiments. In one embodiment, the filling material 140 is a polymer-containing material, including polymers, such as epoxy, urethane, etc., and polymer-containing composites. For example, the filling material 140 may be a lightweight polymer/carbon fiber composite material, which may utilize epoxy or urethane as the polymer portion of the composite material. In another embodiment, the filling material 140 may be a lightweight metal or other light-weight material. It is understood that the density of the filling material 140 may be different relative to the density of a bulk or majority of the face 112, 212 or relative to the density of a portion of the face 112, 212 bordering or adjacent to the filling material 140, and that some portions of the face 112, 212 may have the same or a similar density as the filling material 140. The filling material 140 may also have one or more other properties that are different from the material of face 112, 212, allowing for customization of the face 112, 212 to achieve specified performance characteristics. For example, the filling material 140 may be stiffer or more flexible than the material of the face 112, 212, which can be used to make the face more or less flexible. The filling material 112, 212 may also increase the COR response of the face 112, 212 or areas of the face 112, 212. For example, a stiffer filling material 140 may increase the COR response at areas of the face 112, 212 located away from the filling material 140, and a more flexible or resilient filling material 140 may increase the COR response at areas of the face 112, 212 overlapping the filling material 140 compared to other areas of the face 112, 212.

The filling material 140 may be connected to the face 112, 212 in a variety of different ways. For example, in one embodiment, the filling material 140 may be bonded to the face 112, 212 using an adhesive, including cements or other intermediate connection materials. FIGS. 18-21 illustrate some other embodiments for connection of the filling material 140 to various faces 112, and it is understood that these and other configurations can be used for connecting the filling material 140 to the faces 112 as shown in FIGS. 3-17 and 32-35 and/or to the faces 212 such as shown in FIGS. 24-31. In the embodiment in FIG. 18, fasteners 143 may be used to connect the filling material 140 to the face 112 within the recess 146. In the embodiment in FIG. 19, the face 112 includes a notch 141 within the recess 146 that receives a portion of the filling material 140, around at least a portion of the periphery of the filling material 140, to connect the filling material 112 to the face 112. In the embodiment in FIG. 20, the face 112 includes at least one overlapping flange 145 that overlaps the edge of the filling material 140, around at least a portion of the periphery of the filling material 140, to connect the filling material 112 to the face 112 within the recess 146. In the embodiment in FIG. 21, the face 112 includes at least one internal flange 147 within the recess 146 that penetrates the filling material 140, around at least a portion of the periphery of the filling material 140, to connect the filling material 112 to the face 112. In a further embodiment, the face 112, 212 and the filling material 140 may have other interlocking or otherwise complementarily-engaging structures for connecting the filling material 140 to the face 112, 212. Further connecting techniques known in the art may be used to connect the filling material 140 to the face 112, 212, such as interference fit, clamping, magnetic force, other types of mechanical connectors, swedging/swaging (including hydraulic swedging), etc. In yet another embodiment, the filling material 140 may itself bond to the face 112, 212 (e.g., chemically, adhesively, etc.) without the need for an external connection element or material. For example, the filling material 140 may be formed using a liquid pour-in, and the resultant solidified filling material 140 may be bonded and/or mechanically locked to the face 112, 212. It is understood that any of the configurations of filling materials 140 and/or inserts 142 described herein can be connected to the face 112, 212 using the connection techniques described herein. It is also understood that the filling material 140 may not be located within a recess on the face 112 in some embodiments.

Figure 3:
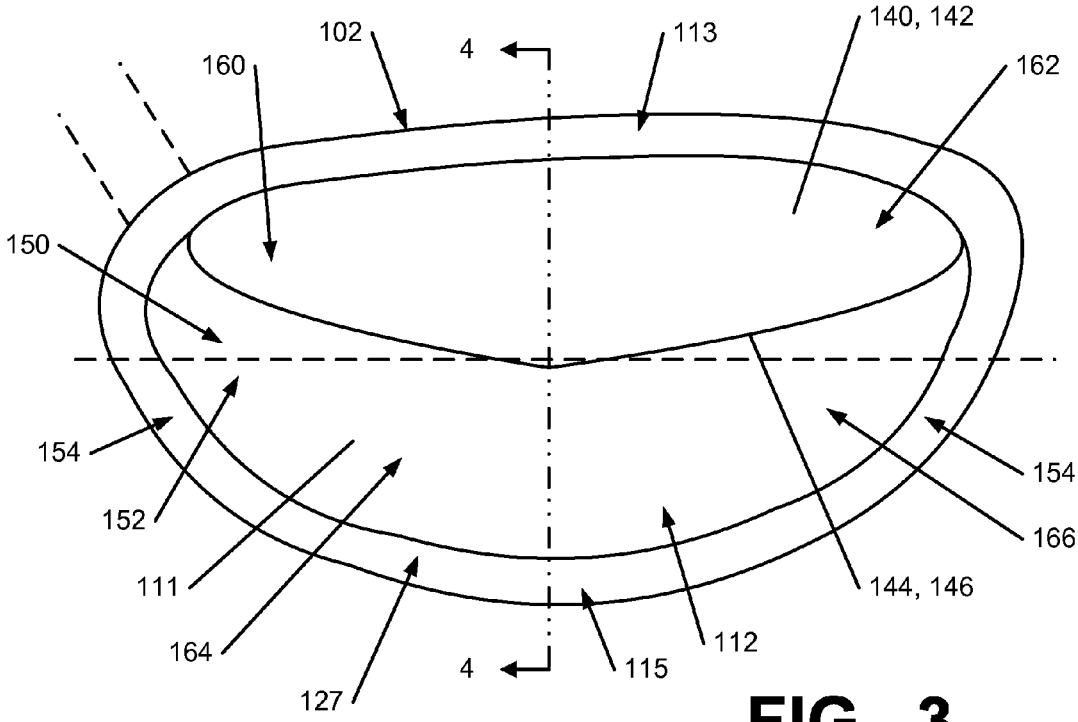
FIG. 3 is a rear view of a second illustrative embodiment of a face of a ball striking head according to the present invention, with a portion of the body of the head broken away to show detail.
Figure 4:
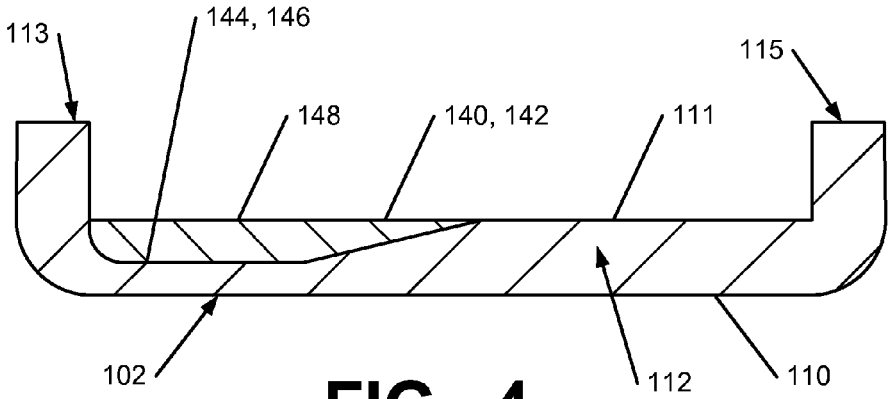
FIG. 4 is a cross-sectional view of the face of FIG. 3, taken along lines 4-4 of FIG. 3.

FIGS. 3-4 illustrate one embodiment of a wood-type head 102 with a face 112 having a thinned portion 144 forming a substantially triangular shaped recess 146 on the rear surface 111. The recess 146 has a filling material 140 forming an insert 142 that fills the recess 146 such that the exposed surface 148 of the filling material 140 is substantially flush with the rear surface 111 of the face 112. The recess 146 and the insert 142 are positioned on the upper portion of the face 112, in the high-heel quadrant 160 and the high-toe quadrant 162, and are partially conforming to and contiguous with the top edge 113 of the face 112. The filling material 140 has a lower density than the material of the face 112, and may also have at least one other property that is different from the face 112 material. The filling material 140 may be any of the materials described above, and the material may be selected for specific properties, such as the flexibility of the material. As shown in FIG. 4, the thickness of the face is relatively smallest within the thinned portion 146, and the thickness of the insert 142 and the depth of the recess 146 are tapered in a complementary manner. In this embodiment, the thickness of the insert 142 gradually increases from the center of the face 112 toward the top edge 113 of the face 112 until the maximum thickness is reached, and likewise, the depth of the recess 146 increases from the center of the face 112 toward the top edge 113 of the face 112 until the maximum depth is reached. Additionally, the widths of the recess 146 and the insert 142 are tapered, with the width increasing from the center of the face 112 toward the top edge 113 of the face 112 until a maximum width is reached near the top edge 113. This tapering results in a greater proportion of the volume of the insert 142 being positioned close to the top edge 113 of the face 112, and a greater proportion of the weight of the face 112 being positioned close to the bottom edge 115. As a result, the center of gravity of the face 112 is shifted lower on the face 112, as compared to a standard face having the same geometry with no thinned portion 144. Similarly, the width tapering results in a higher proportion of the less dense filling material 140 being positioned near the vertical centerline of the face 112 compared to a non-tapered insert of the same maximum width, which may slightly increase the moment of inertia of the face 112.

Figure 5:
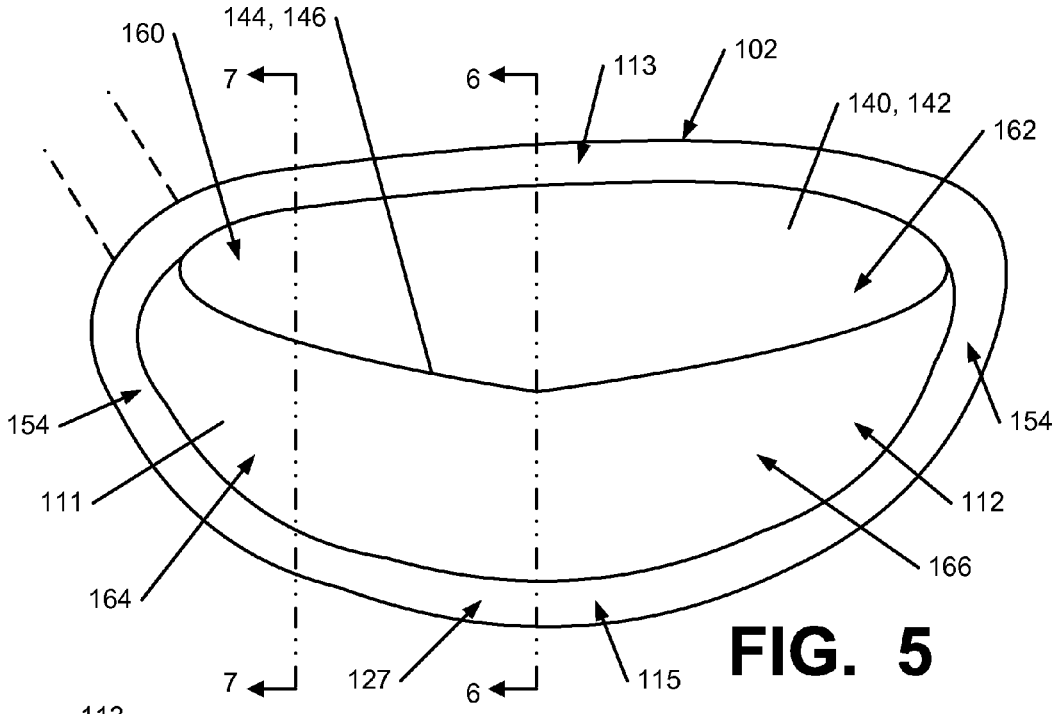
FIG. 5 is a rear view of a third illustrative embodiment of a face of a ball striking head according to the present invention, with a portion of the body of the head broken away to show detail.
Figure 6:
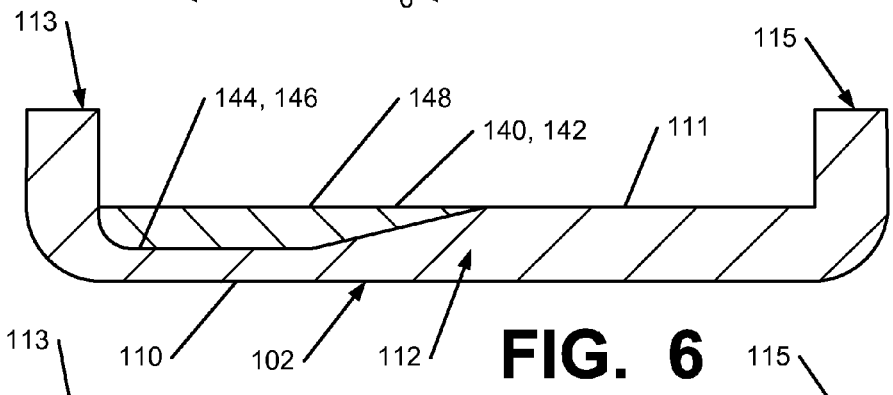
FIG. 6 is a cross-sectional view of the face of FIG. 5, taken along lines 6-6 of FIG. 5.
Figure 7:
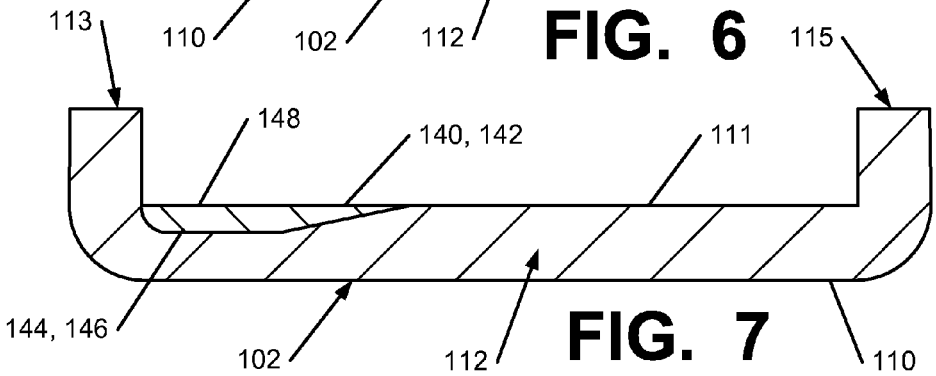
FIG. 7 is a cross-sectional view of the face of FIG. 5, taken along lines 7-7 of FIG. 5.

FIGS. 5-7 illustrate another embodiment of a wood-type head 102 with a face 112 having a thinned portion 144 forming a substantially triangular shaped recess 146 on the rear surface 111. The recess 146 has a filling material 140 forming an insert 142 that fills the recess 146 such that the exposed surface 148 of the filling material 140 is substantially flush with the rear surface 111 of the face 112. The recess 146 and the insert 142 have profiles similar to the recess 146 and insert 142 in FIG. 3, and are likewise positioned on the upper portion of the face 112, in the high-heel quadrant 160 and the high-toe quadrant 162. However, the recess 146 and the insert 142 in FIGS. 5-7 are tapered in two directions, in contrast to the recess 146 and insert 142 in FIGS. 3-4, which are tapered in one direction, as described above. As seen in FIGS. 6-7, the depth of the recess 146 and the thickness of the insert 142 increase in a vertical direction toward the top edge 113 of the face 112. Likewise, as seen from the differences between FIGS. 6 and 7, the depth of the recess 146 and the thickness of the insert 142 decrease in directions from the vertical centerline of the face 112 to the lateral edges 154 of the face 112 proximate the heel 120 and toe 122.

Figure 8:
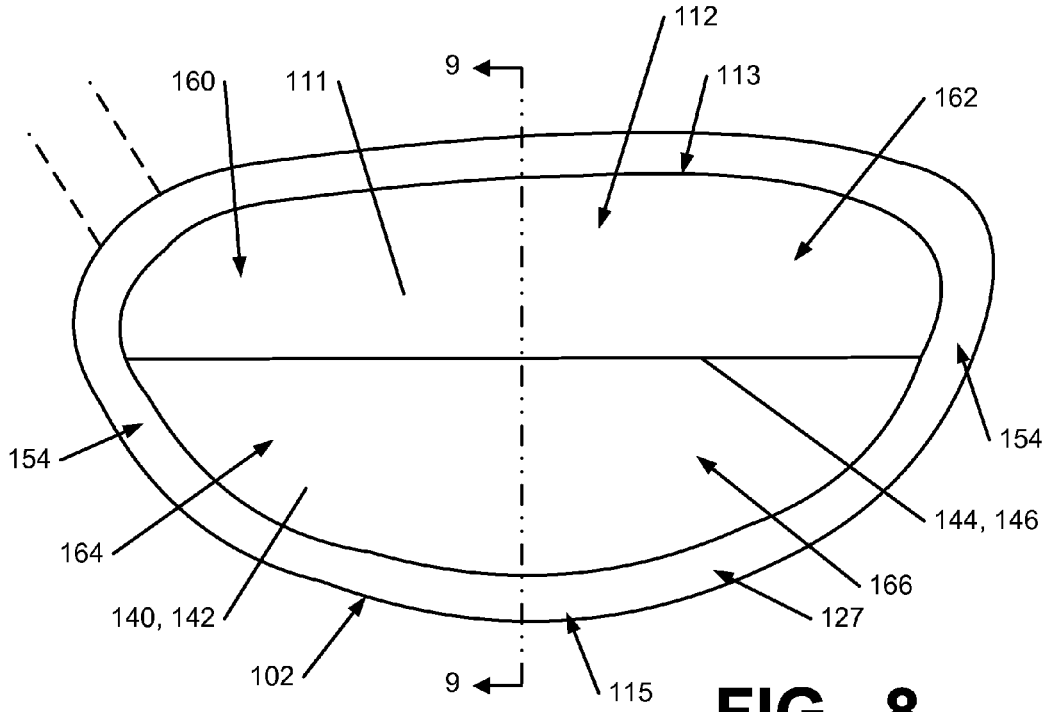
FIG. 8 is a rear view of a fourth illustrative embodiment of a face of a ball striking head according to the present invention, with a portion of the body of the head broken away to show detail.
Figure 9:
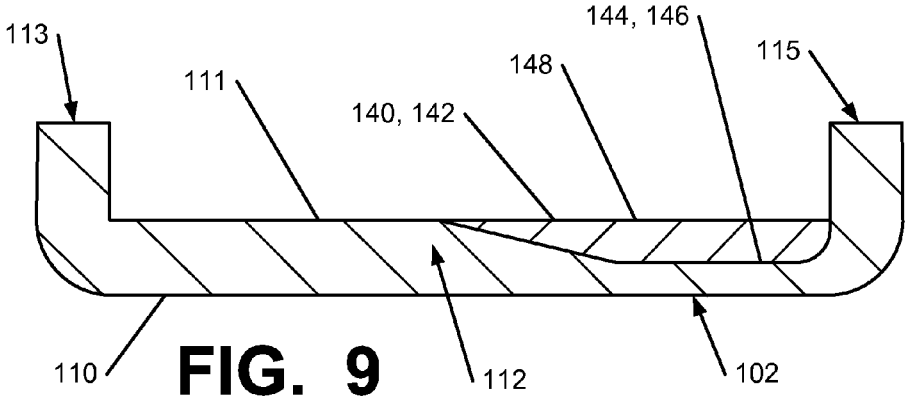
FIG. 9 is a cross-sectional view of the face of FIG. 8, taken along lines 9-9 of FIG. 8.

FIGS. 8-9 illustrate another embodiment of a wood-type head 102 with a face 112 having a thinned portion 144 forming a recess 146 on the rear surface 111 that has a shape generally conforming to and contiguous with the peripheral edges 127 of the face 112, including the bottom edge 115 and portions of the lateral edges 154. The recess 146 has a filling material 140 forming an insert 142 that fills the recess 146 such that the exposed surface 148 of the filling material 140 is substantially flush with the rear surface 111 of the face 112. In this embodiment, the recess 146 and the insert 142 are positioned on the lower portion of the face 112, in the low-heel quadrant 164 and the low-toe quadrant 166. The depth of the recess 146 and the thickness of the insert 142 are tapered, such that the depth of the recess 146 and the thickness of the insert 142 increase in a vertical direction toward the bottom edge 115 of the face 112. Accordingly, in the embodiment of FIGS. 8-9, the weight distribution and center of gravity of the face 112 are shifted upward, toward the top edge 113 of the face 112.

Figure 10:
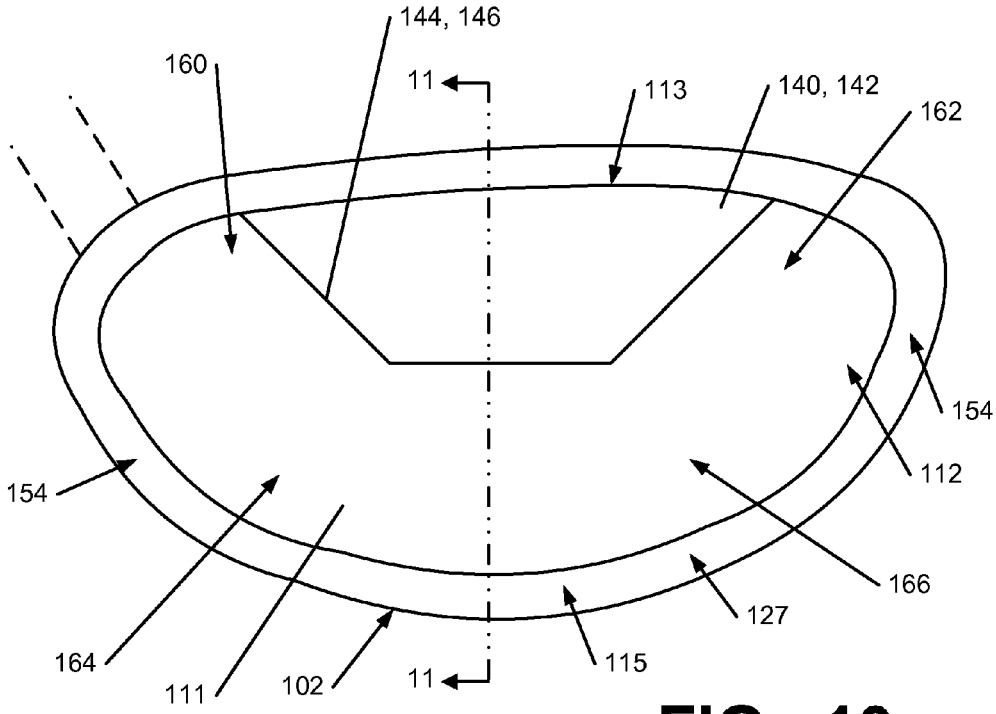
FIG. 10 is a rear view of a fifth illustrative embodiment of a face of a ball striking head according to the present invention, with a portion of the body of the head broken away to show detail.
Figure 11:
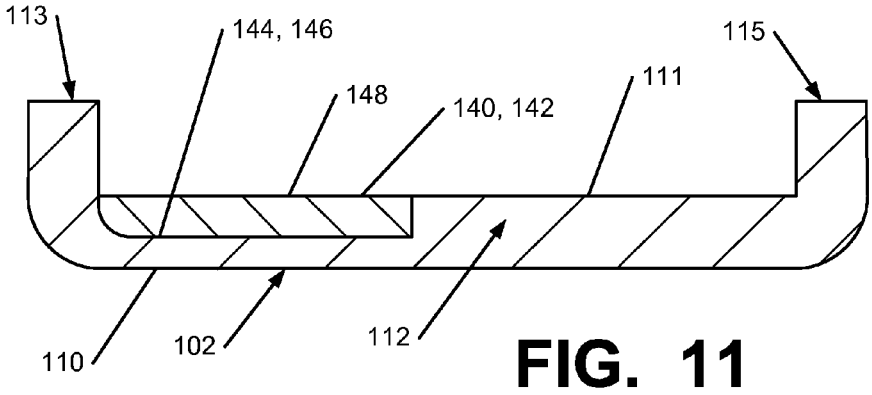
FIG. 11 is a cross-sectional view of the face of FIG. 10, taken along lines 11-11 of FIG. 10.

FIGS. 10-11 illustrate another embodiment of a wood-type head 102 with a face 112 having a thinned portion 144 forming a recess 146 on the rear surface 111 that has a generally trapezoidal shape generally conforming to and contiguous with the peripheral edges 127 of the face 112, including a portion of the top edge 113. The recess 146 has a filling material 140 forming an insert 142 that fills the recess 146 such that the exposed surface 148 of the filling material 140 is substantially flush with the rear surface 111 of the face 112. In this embodiment, the recess 146 and the insert 142 are positioned on the upper portion of the face 112, in the high-heel quadrant 160 and the high-toe quadrant 162. Accordingly, in the embodiment of FIGS. 10-11, the weight distribution and center of gravity of the face 112 are shifted downward, toward the bottom edge 115 of the face 112. Additionally, in this embodiment, the depth of the recess 146 and the thickness of the insert 142 are relatively constant throughout and are not tapered, as seen in FIG. 11.

Figure 12:
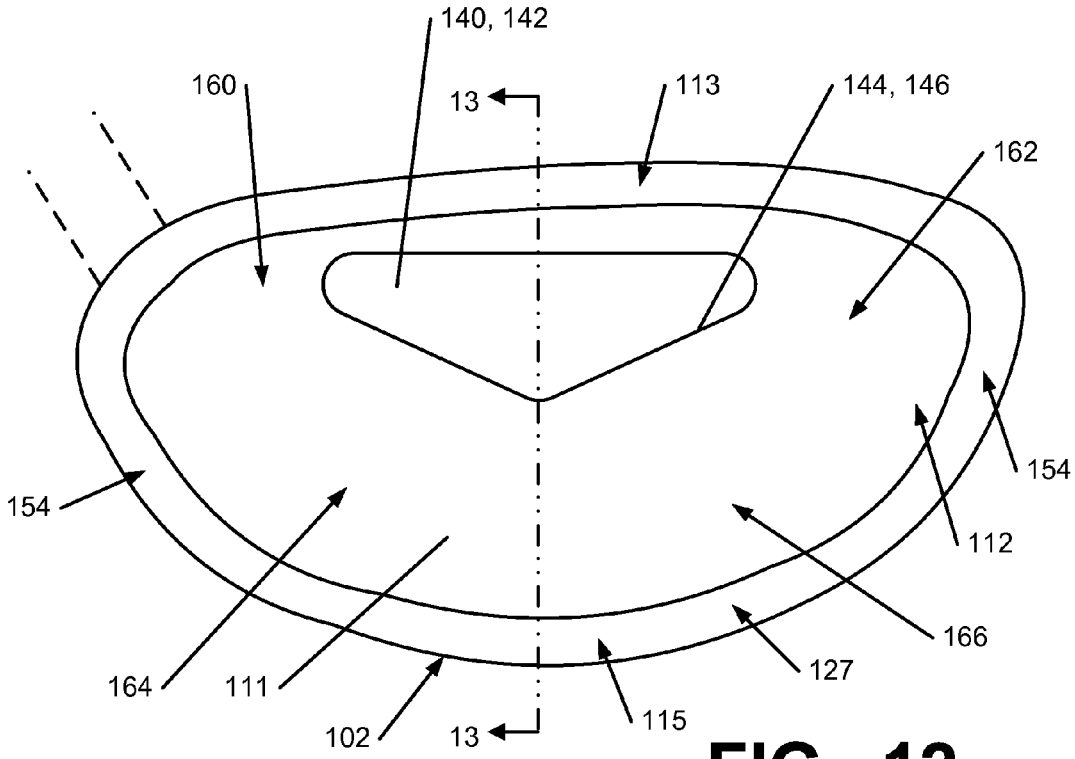
FIG. 12 is a rear view of a sixth illustrative embodiment of a face of a ball striking head according to the present invention, with a portion of the body of the head broken away to show detail.
Figure 13:
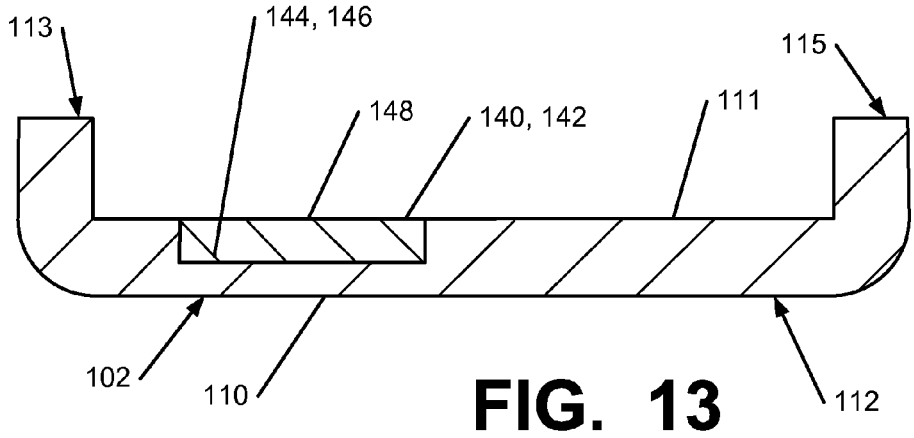
FIG. 13 is a cross-sectional view of the face of FIG. 12, taken along lines 13-13 of FIG. 12.

FIGS. 12-13 illustrate another embodiment of a wood-type head 102 with a face 112 having a thinned portion 144 forming a recess 146 on the rear surface 111 that has a generally triangular shape that is spaced from the peripheral edges 127 of the face 112. The recess 146 is closest to, and spaced from, the top edge 113 of the face, and the upper boundary of the recess 146 runs generally parallel to the top edge 113. The recess 146 has a filling material 140 forming an insert 142 that fills the recess 146 such that the exposed surface 148 of the filling material 140 is substantially flush with the rear surface 111 of the face 112. In this embodiment, the recess 146 and the insert 142 are positioned on the upper portion of the face 112, in the high-heel quadrant 160 and the high-toe quadrant 162. Accordingly, in the embodiment of FIGS. 12-13, the weight distribution and center of gravity of the face 112 are shifted downward, toward the bottom edge 115 of the face 112. Additionally, in this embodiment, the depth of the recess 146 and the thickness of the insert 142 are relatively constant throughout and are not tapered, as seen in FIG. 13.

Figure 14:
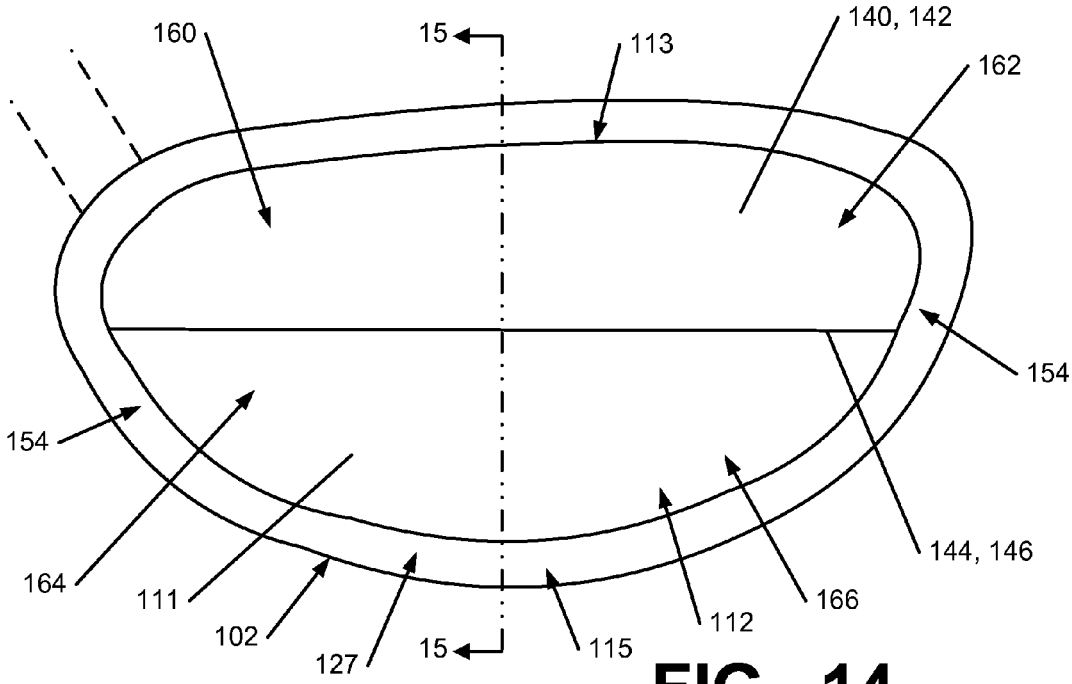
FIG. 14 is a rear view of a seventh illustrative embodiment of a face of a ball striking head according to the present invention, with a portion of the body of the head broken away to show detail.
Figure 15:
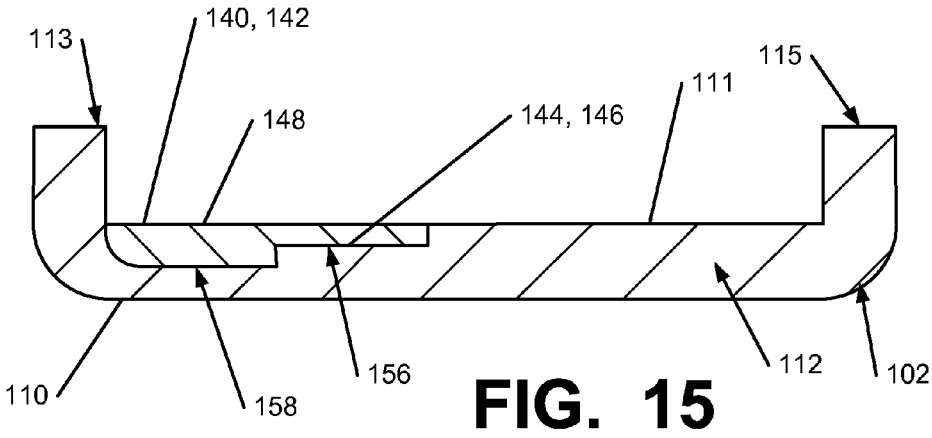
FIG. 15 is a cross-sectional view of the face of FIG. 14, taken along lines 15-15 of FIG. 14.

FIGS. 14-15 illustrate another embodiment of a wood-type head 102 with a face 112 having a thinned portion 144 forming a recess 146 on the rear surface 111 that has a shape generally conforming to and contiguous with the peripheral edges 127 of the face 112, including the top edge 113. The recess 146 has a filling material 140 forming an insert 142 that fills the recess 146 such that the exposed surface 148 of the filling material 140 is substantially flush with the rear surface 111 of the face 112. In this embodiment, the recess 146 and the insert 142 are positioned on the upper portion of the face 112, in the high-heel quadrant 160 and the high-toe quadrant 162. Additionally, in this embodiment, the depth of the recess 146 and the thickness of the insert 142 have a "stepped" configuration, as seen in FIG. 11. In other words, in a first area 156, the recess 146 has a smaller depth and the insert 142 has a smaller thickness, and in a second area 158, the recess 146 has a larger depth and the insert 142 has a larger thickness. The first area 156 is positioned more proximate to the center of the face 112, and the second area 158 is positioned more proximate the top edge 113 of the face 112. Similarly to the tapered configuration shown in FIGS. 3-4 and discussed above, in this configuration, the weight distribution and center of gravity of the face 112 are shifted downward, toward the bottom edge 115 of the face 112.

Figure 16:
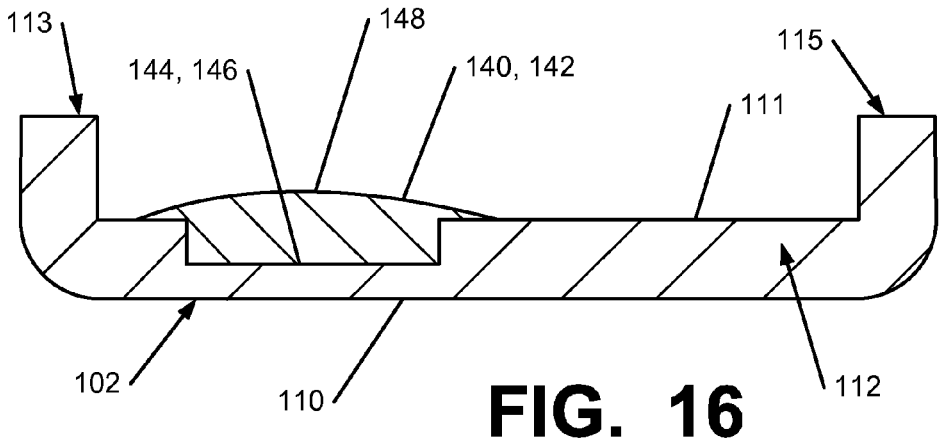
FIG. 16 is a cross-sectional view of an eighth illustrative embodiment of a face of a ball striking head according to the present invention, with a portion of the body of the head broken away to show detail.

FIG. 16 illustrates another embodiment a face 112 for a wood-type head, having a thinned portion 144 forming a recess 146 on the rear surface 111, shaped and configured similarly to the recess 146 of FIGS. 12-13. The recess 146 has a filling material 140 forming an insert 142 that fills the recess 146. However, the filling material 140 in FIG. 16 over-fills the recess 146, and the exposed surface 148 of the filling material 140 is not flush with the rear surface 111 of the face 112. The filling material 140 further spreads beyond the boundary of the recess 146 and onto adjacent portions of the face 112. As seen in FIG. 16, the recess 146 is located proximate the top edge 113 of the face 112, and the depth of the recess 146 and the thickness of the insert 142 are generally consistent. Accordingly, in this configuration, the weight distribution and center of gravity of the face 112 are shifted downward, toward the bottom edge 115 of the face 112.

Figure 17:
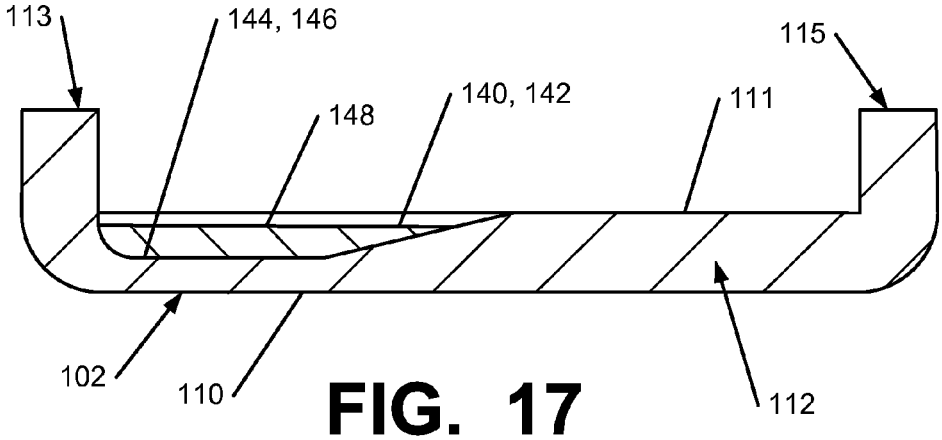
FIG. 17 is a cross-sectional view of a ninth illustrative embodiment of a face of a ball striking head according to the present invention, with a portion of the body of the head broken away to show detail.
Figure 18:
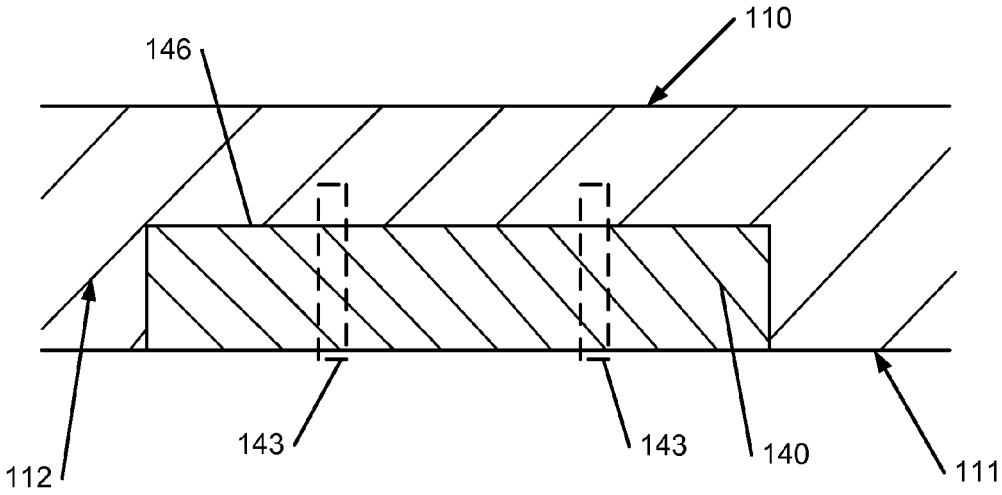
FIG. 18 is a cross-sectional view of one illustrative embodiment of a connection between a face and a filling material.
Figure 19:
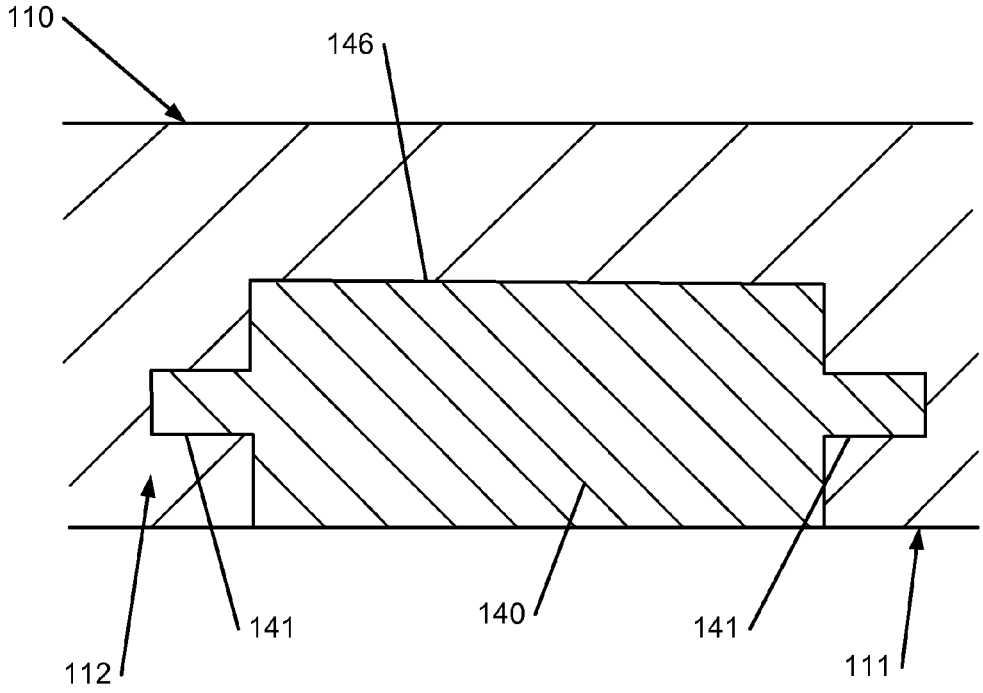
FIG. 19 is a cross-sectional view of another illustrative embodiment of a connection between a face and a filling material.
Figure 20:
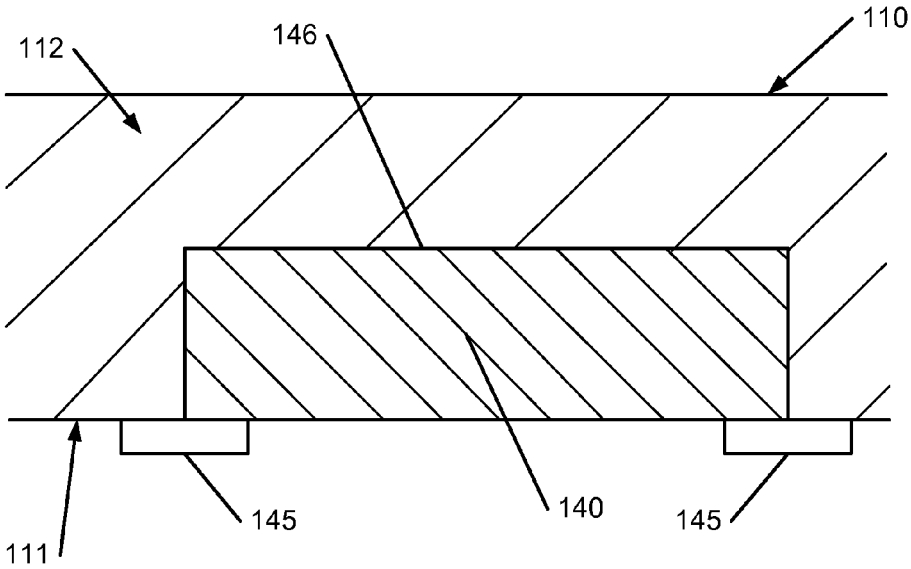
FIG. 20 is a cross-sectional view of another illustrative embodiment of a connection between a face and a filling material.
Figure 21:
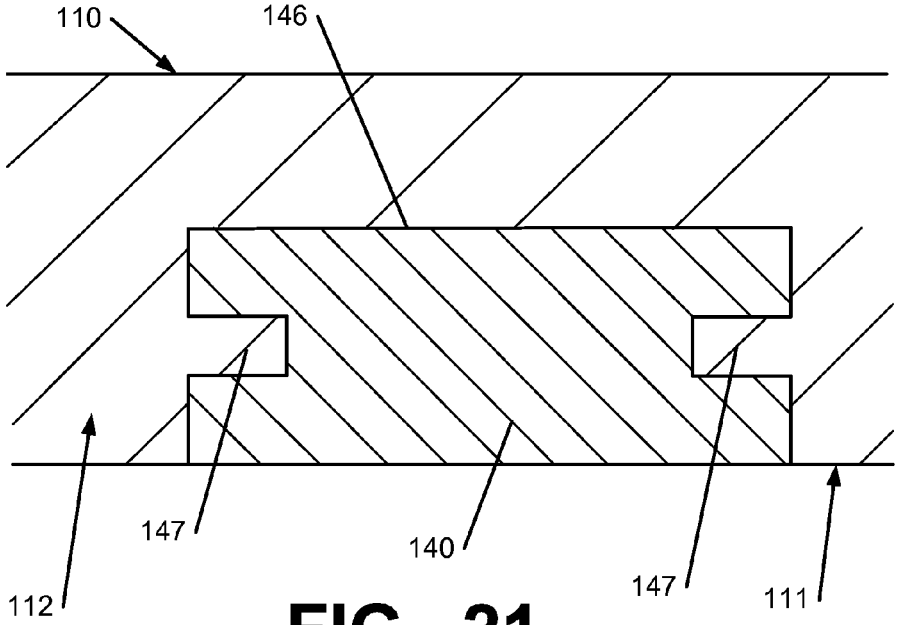
FIG. 21 is a cross-sectional view of another illustrative embodiment of a connection between a face and a filling material.

FIG. 17 illustrates another embodiment of a face 112 for a wood-type head, having a thinned portion 144 forming a recess 146 on the rear surface 111, shaped and configured similarly to the recess 146 of FIGS. 3-4. The recess 146 has a filling material 140 forming an insert 142 that fills the recess 146. However, the filling material 140 in FIG. 17 does not completely fill the recess 146, and the exposed surface 148 of the filling material 140 is not flush with the rear surface 111 of the face 112. As seen in FIG. 17, the recess 146 is located proximate the top edge 113 of the face 112, and the depth of the recess 146 and the thickness of the insert 142 are tapered, and increase in a vertical direction from the horizontal centerline of the face 112 to the top edge 113 of the face 112. Accordingly, in this configuration, the weight distribution and center of gravity of the face 112 are shifted downward, toward the bottom edge 115 of the face 112.

Figure 32:
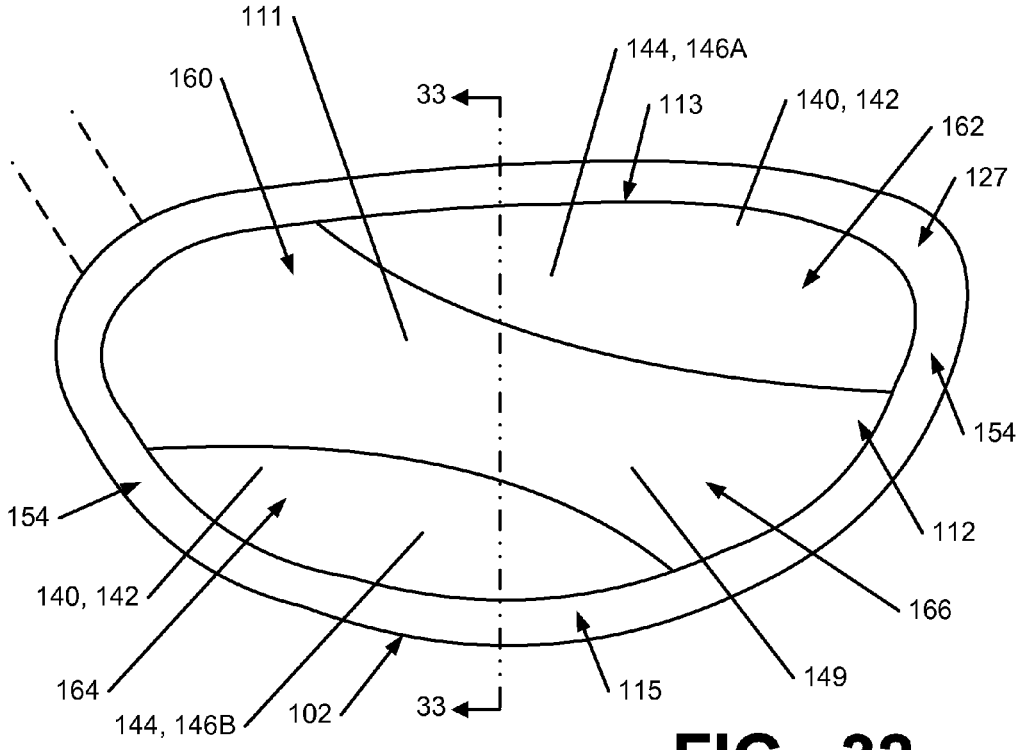
FIG. 32 is a rear view of a fourteenth illustrative embodiment of a face of a ball striking head according to the present invention, with a portion of the body of the head broken away to show detail.
Figure 33:
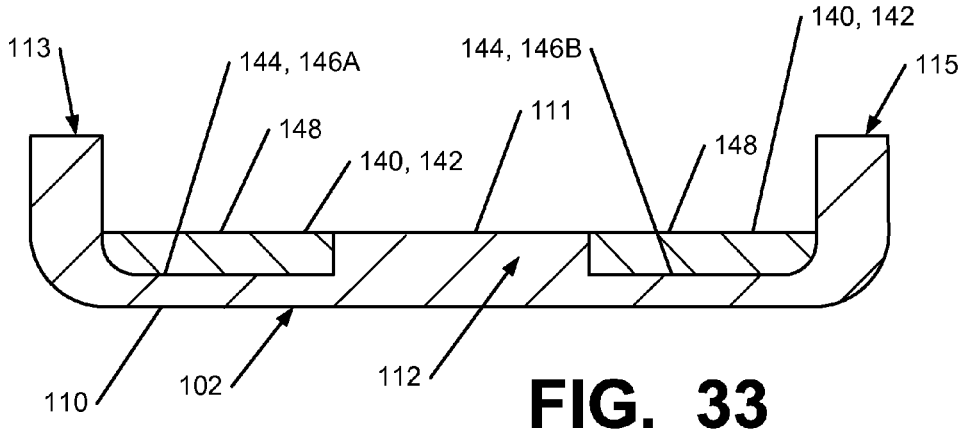
FIG. 33 is a cross-sectional view of the face of FIG. 32, taken along lines 33-33 of FIG. 32.

FIGS. 32-33 illustrate another embodiment of a wood-type head 102 with a face 112 having two thinned portions 144, each forming a recess 146A-B on the rear surface 111 that has a curvilinear shape that is spaced from the peripheral edges 127 of the face 112. One recess 146A is located predominately in the high-toe area 162 of the face 112, and the boundaries of the recess 146A run generally parallel to the top edge 113 and the lateral edge 154 at the toe 122 of the face 112. The other recess 146B is located predominately in the low-heel area 164 of the face 112, and the boundaries of the recess 146B run generally parallel to the bottom edge 115 and the lateral edge 154 at the toe heel 120 of the face 112. The recesses 146A-B each have a filling material 140 forming an insert 142 that fills the recess 146A-B such that the exposed surface 148 of the filling material 140 is substantially flush with the rear surface 111 of the face 112. Accordingly, in the embodiment of FIGS. 32-33, the weight distribution and center of gravity of the face 112 are shifted downward and toward the high-heel area 160 and the low-toe area 166 of the face 112. Additionally, in this embodiment, the depths of the recesses 146A-B and the thicknesses of the inserts 142 are relatively constant throughout and are not tapered, as seen in FIG. 33. The positions of the inserts 142 and the recesses 146A-B in this embodiment create a curvilinear, diagonal portion 149 extending from the high-heel area 160 diagonally across the center of the face 112 to the low-toe area 166 of the face 112. This diagonal portion 149 has a greater weight distribution than the thinned portions 144, and may enhance energy and velocity transfer and decrease twisting of the head 102 during impacts in the high-heel area 160 and the low-toe area 166 of the face 112. In another embodiment, the face 112 may have a diagonal portion 149 created by multiple recesses 144 and inserts 142, extending from the high-toe area 162 to the low-heel area 164 of the face 112, otherwise configured similarly to the embodiment shown in FIGS. 32-33.

Figure 34:
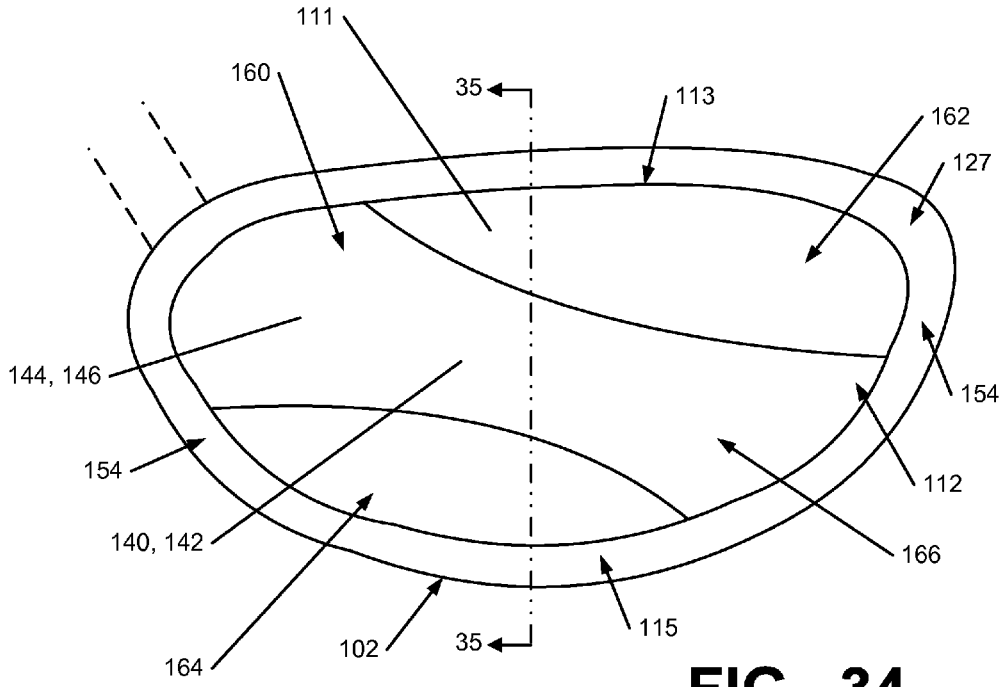
FIG. 34 is a rear view of a fifteenth illustrative embodiment of a face of a ball striking head according to the present invention, with a portion of the body of the head broken away to show detail.
Figure 35:
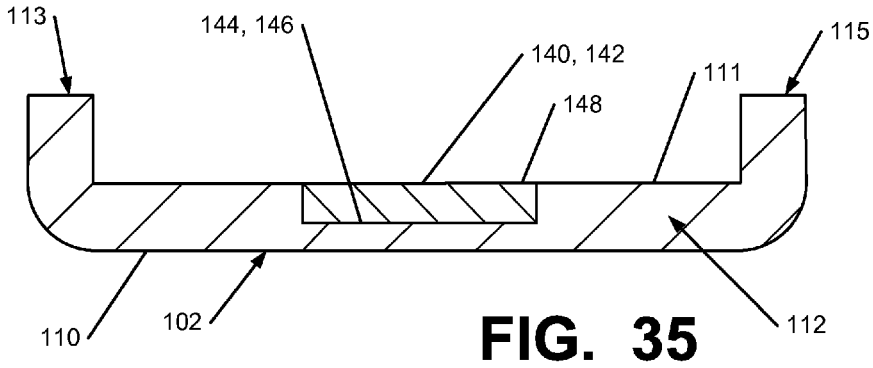
FIG. 35 is a cross-sectional view of the face of FIG. 34, taken along lines 35-35 of FIG. 34.

FIGS. 34-35 illustrate another embodiment of a wood-type head 102 with a face 112 having a thinned portion 144 forming a recess 146 on the rear surface 111 that has a curvilinear shape, and portions of the recess 146 are spaced from the peripheral edges 127 of the face 112. The curvilinear recess 146 extends across the inner surface 111 of the face 112, from the high-heel area 160 diagonally across the center of the face 112 to the low-toe area 166 of the face 112. The recess has a filling material 140 forming an insert 142 that fills the recess 146, such that the exposed surface 148 of the filling material 140 is substantially flush with the rear surface 111 of the face 112. Accordingly, in the embodiment of FIGS. 32-33, the weight distribution and center of gravity of the face 112 are shifted toward the high-toe area 162 and the low-heel area 164 of the face 112. Additionally, in this embodiment, the depth of the recess 146 and the thickness of the insert 142 are relatively constant throughout and are not tapered, as seen in FIG. 34. The weight distribution of the head 102 in this embodiment may enhance energy and velocity transfer and decrease twisting of the head 102 during impacts in the high-toe area 162 and the low-heel area 164 of the face 112. In another embodiment, the face 112 may have a diagonal recess 146 and insert 142 created by extending from the high-toe area 162 to the low-heel area 164 of the face 112, otherwise configured similarly to the embodiment shown in FIGS. 34-35.

Figure 24:
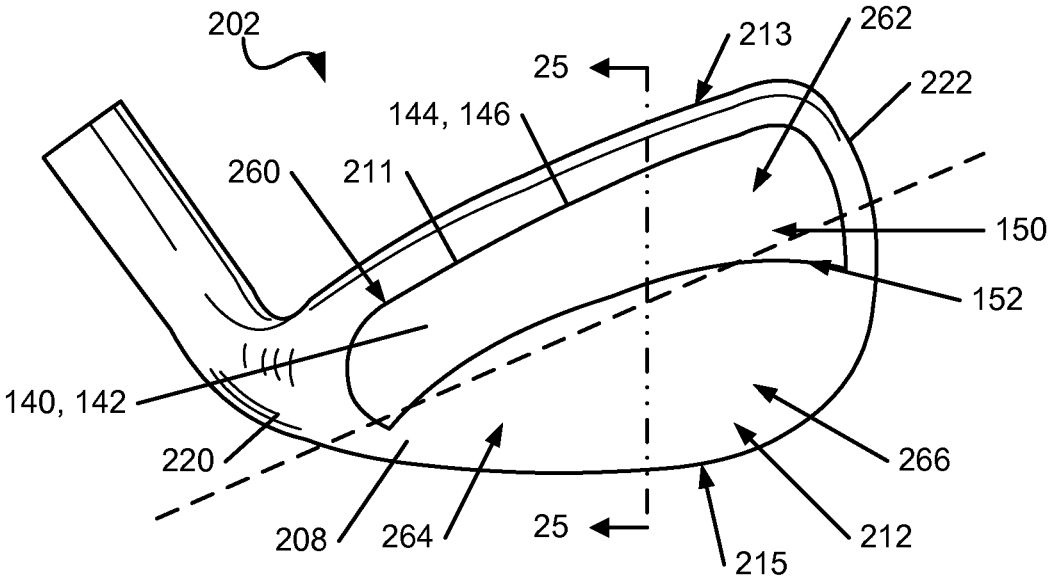
FIG. 24 is a rear view of a tenth illustrative embodiment of a ball striking head according to the present invention.

FIGS. 24-25 illustrate another embodiment of an iron-type head 202 with a face 212 having a thinned portion 144 forming a recess 146 on the rear surface 211 that has a generally curvilinear shape that is spaced from the peripheral edges 127 of the face 212. The recess 146 is spaced from the top edge 213 and other peripheral edges 127 of the face 212, and the upper boundary of the recess 146 runs generally parallel to the top edge 213. The recess 146 has a filling material 140 forming an insert 142 that fills the recess 146 such that the exposed surface 148 of the filling material 140 is substantially flush with the rear surface 211 of the face 212. As described above, it is understood that in a head 202 as shown in FIGS. 24-25, having no internal cavity, the rear surface 211 of the face 212 may be partially or entirely embodied by a surface of the body 208 of the head 202. In this embodiment, the recess 146 and the insert 142 are positioned on the upper portion of the face 212, predominately in the high-heel quadrant 160 and the high-toe quadrant 162. Additionally, the depth of the recess 146 and the thickness of the insert 142 are tapered, such that the depth of the recess 146 and the thickness of the insert 142 increase in a vertical direction from the horizontal centerline of the face 212 toward the bottom edge 215 of the face 212. Accordingly, in the embodiment of FIGS. 24-25, the weight distribution and center of gravity of the face 212 are shifted downward, toward the bottom edge 215 of the face 212.

Figure 26:
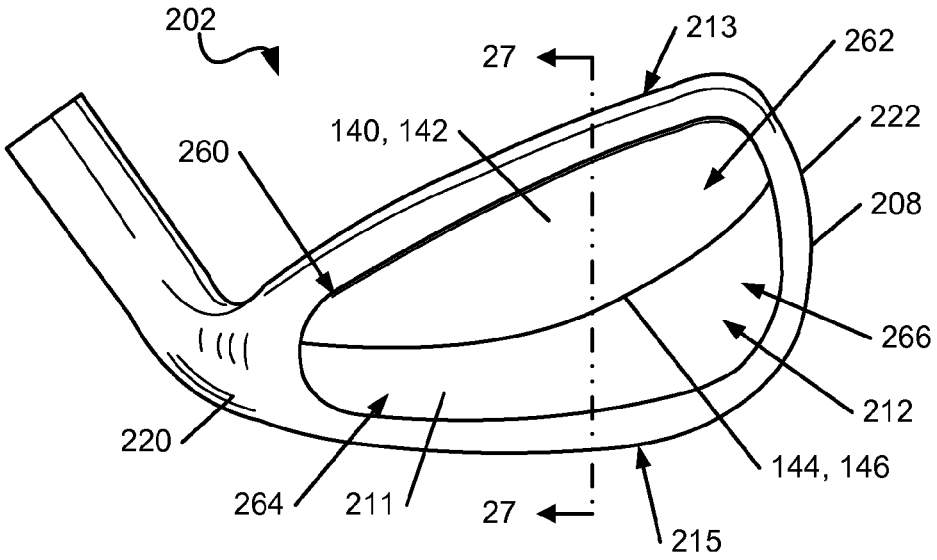
FIG. 26 is a rear view of an eleventh illustrative embodiment of a ball striking head according to the present invention.
Figure 27:
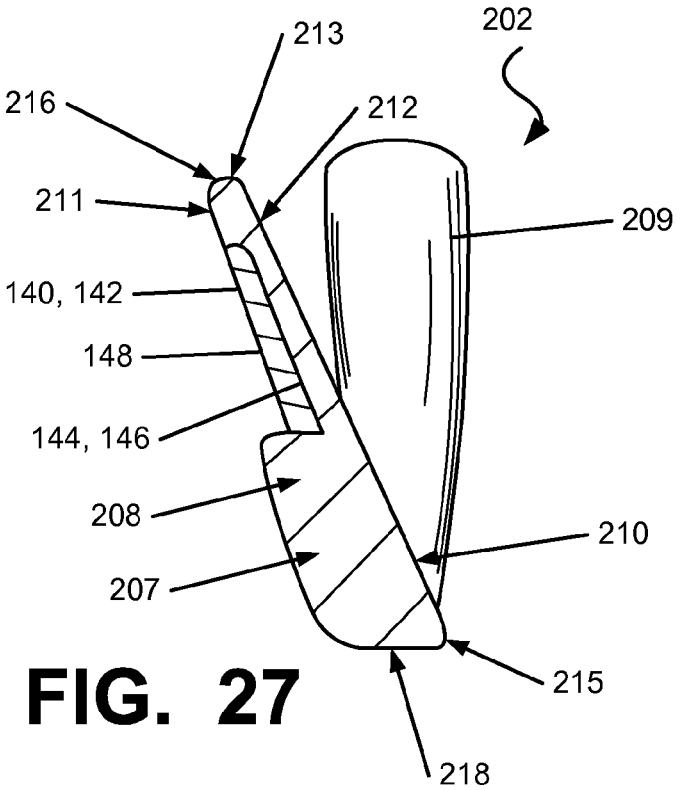
FIG. 27 is a cross-sectional view of the face of FIG. 26, taken along lines 27-27 of FIG. 26.

FIGS. 26-27 illustrate another embodiment of an iron-type head 202 with a face 212 having a thinned portion 144 forming a recess 146 on the rear surface 211 that has a generally curvilinear shape that is spaced from the peripheral edges 127 of the face 212. The recess 146 is spaced from the top edge 213 and other peripheral edges 127 of the face 212, and the upper boundary of the recess 146 runs generally parallel to the top edge 213. The recess 146 has a filling material 140 forming an insert 142 that fills the recess 146 such that the exposed surface 148 of the filling material 140 is substantially flush with the rear surface 211 of the face 212. As described above, it is understood that in a head 202 as shown in FIGS. 26-27, having no internal cavity, the rear surface 211 of the face 212 may be partially or entirely embodied by a surface of the body 208 of the head 202. In this embodiment, the recess 146 and the insert 142 are positioned on the upper portion of the face 212, predominately in the high-heel quadrant 160 and the high-toe quadrant 162. The depth of the recess 146 and the thickness of the insert 142 are relatively constant throughout and are not tapered, as seen in FIG. 27. Accordingly, in the embodiment of FIGS. 26-27, the weight distribution and center of gravity of the face 212 and the head 202 are shifted downward, toward the bottom edge 215 of the face 212. Additionally, the head 202 in FIGS. 26-27 has an enlarged lower body portion 207, having a larger mass and volume than the top portions of the head 202, which further shifts the weight distribution and the center of gravity of the head 202 downward. Such an enlarged lower body portion 207 may be employed in a full or partial cavity-back iron, as well as other types of golf clubs and ball striking devices.

Figure 28:
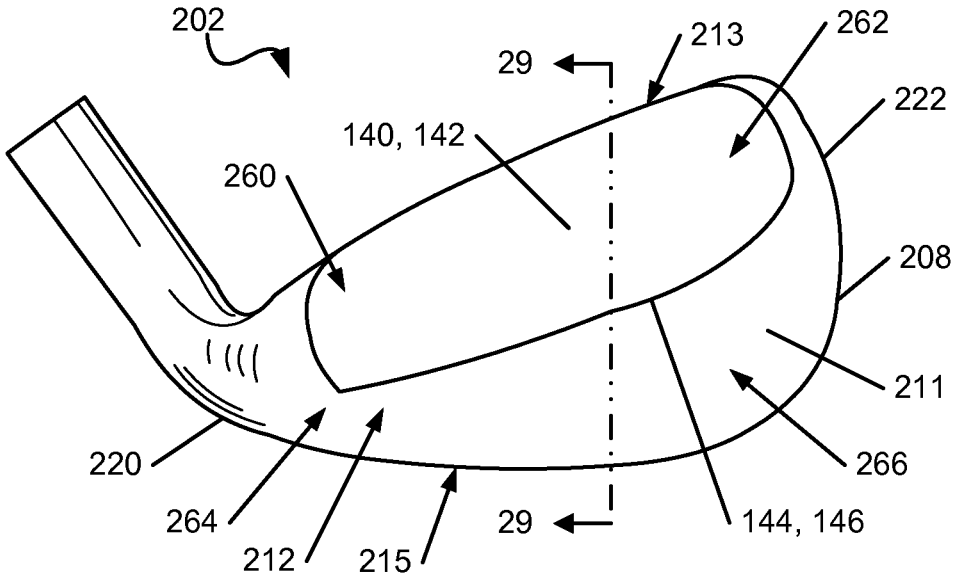
FIG. 28 is a rear view of a twelfth illustrative embodiment of a ball striking head according to the present invention.
Figure 29:
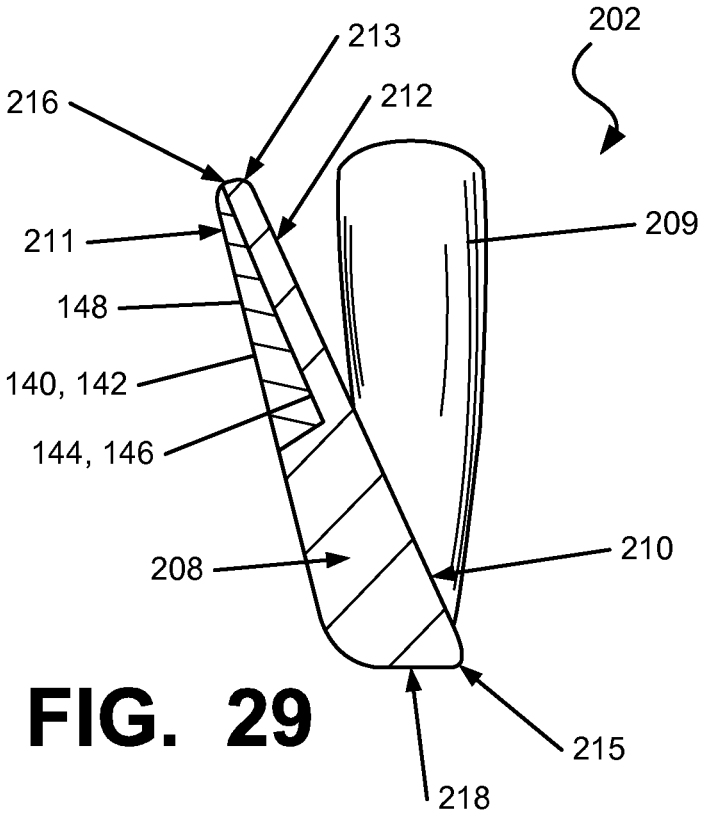
FIG. 29 is a cross-sectional view of the face of FIG. 28, taken along lines 29-29 of FIG. 28.

FIGS. 28-29 illustrate another embodiment of an iron-type head 202 with a face 212 having a thinned portion 144 forming a recess 146 on the rear surface 211 that has a generally curvilinear shape generally conforming to and contiguous with the peripheral edges 227 of the face 212, including the top edge 213. The recess 146 has a filling material 140 forming an insert 142 that fills the recess 146 such that the exposed surface 148 of the filling material 140 is substantially flush with the rear surface 211 of the face 212. As described above, it is understood that in a head 202 as shown in FIGS. 28-29, having no internal cavity, the rear surface 211 of the face 212 may be partially or entirely embodied by a surface of the body 208 of the head 202. In this embodiment, the recess 146 and the insert 142 are positioned on the upper portion of the face 212, predominately in the high-heel quadrant 160 and the high-toe quadrant 162. Additionally, the depth of the recess 146 and the thickness of the insert 142 are tapered, such that the depth of the recess 146 and the thickness of the insert 142 increase in a vertical direction from the horizontal centerline of the face 212 toward the bottom edge 215 of the face 212. Accordingly, in the embodiment of FIGS. 28-29, the weight distribution and center of gravity of the face 212 are shifted downward, toward the bottom edge 215 of the face 212.

Figure 30:
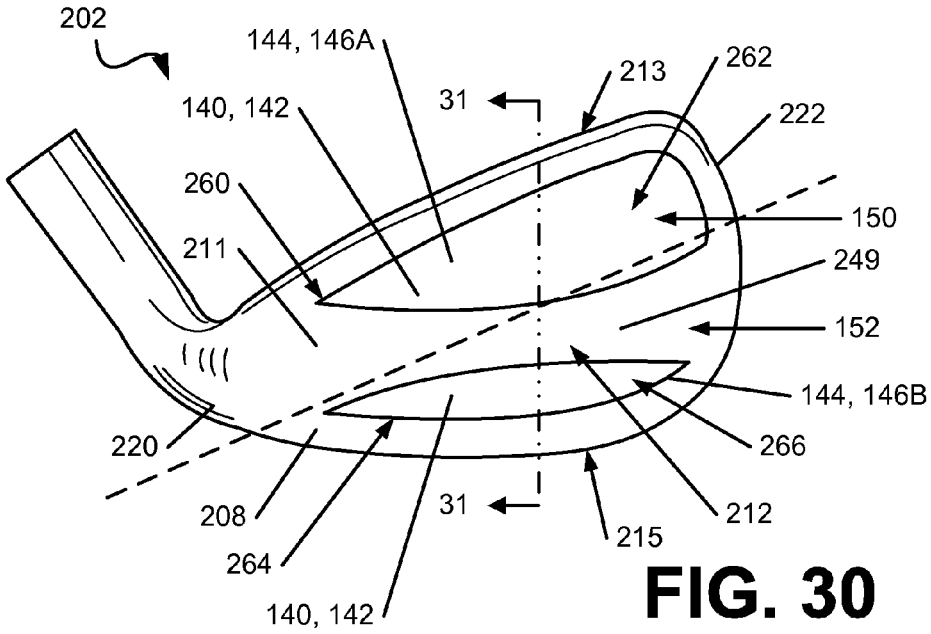
FIG. 30 is a rear view of a thirteenth illustrative embodiment of a ball striking head according to the present invention.
Figure 31:
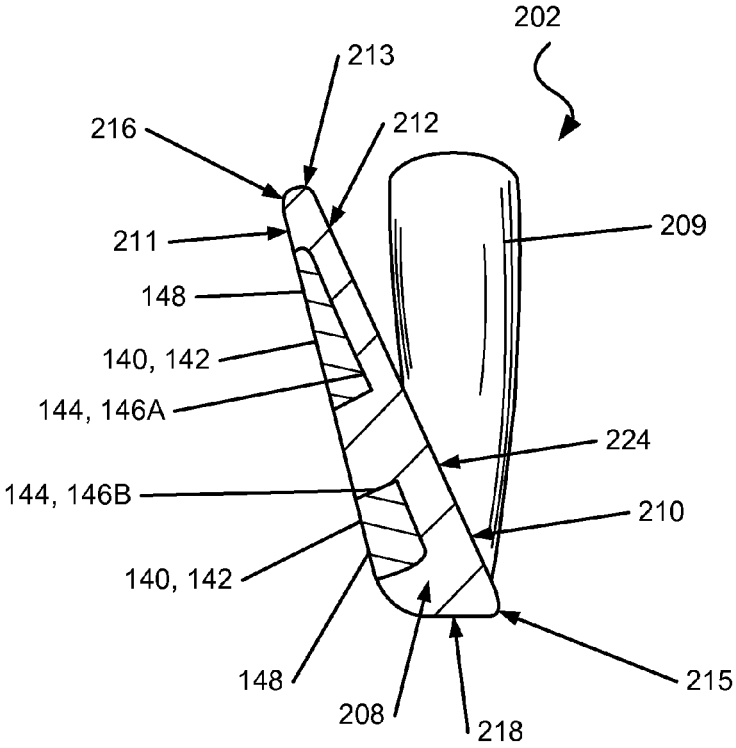
FIG. 31 is a cross-sectional view of the face of FIG. 30, taken along lines 31-31 of FIG. 30.

FIGS. 30-31 illustrate another embodiment of an iron-type head 202 with a face 212 having two thinned portions 144, each forming a recess 146A-B on the rear surface 211 that has a curvilinear shape that is spaced from the peripheral edges 127 of the face 212, similarly to the head 102 in FIGS. 32-33. As described above, it is understood that in a head 202 as shown in FIGS. 30-31, having no internal cavity, the rear surface 211 of the face 212 may be partially or entirely embodied by a surface of the body 208 of the head 202. One recess 146A is located predominately in the high-toe area 262 of the face 212, and the boundaries of the recess 146A run generally parallel to the top edge 213 and the lateral edge 254 at the toe 222 of the face 212. The other recess 146B is located predominately in the low-heel area 264 of the face 212, and the boundaries of the recess 146B run generally parallel to the bottom edge 215 and the lateral edge 254 at the toe heel 220 of the face 212. The recesses 146A-B each have a filling material 140 forming an insert 142 that fills the recess 146A-B such that the exposed surface 148 of the filling material 140 is substantially flush with the rear surface 211 of the face 212. Accordingly, in the embodiment of FIGS. 30-31, the weight distribution and center of gravity of the face 212 are shifted downward and toward the high-heel area 160 and the low-toe area 166 of the face 212. Additionally, in this embodiment, the depths of the recesses 146A-B and the thicknesses of the inserts 142 are slightly tapered, as seen in FIG. 30. The positions of the inserts 142 and the recesses 146A-B in this embodiment create a curvilinear, diagonal portion 249 extending from the high-heel area 260 diagonally across the center of the face 112 to the low-toe area 266 of the face 212. This diagonal portion 249 has a greater weight distribution than the thinned portions 144, and may enhance energy and velocity transfer and decrease twisting of the head 202 during impacts in the high-heel area 260 and the low-toe area 266 of the face 212. In another embodiment, the face 212 may have a diagonal portion 249 created by multiple recesses 144 and inserts 142, extending from the high-toe area 262 to the low-heel area 264 of the face 212, otherwise configured similarly to the embodiment shown in FIGS. 30-31. In a further embodiment, the positions of the diagonal portion 249 and the inserts 142 may be transposed, with a configuration similar to that of the head 102 shown in FIGS. 34-35.

FIGS. 3-17 and 24-35 show various different configurations for thinned portions 144, recesses 146, filling materials 140, and inserts 142 that may be used in connection with the head 102. It is understood that each of these components is shown in a particular orientation, but that the orientation of such components may be changed in other designs, such as by rotating the thinned portions 144, recesses 146, filling materials 140, and/or inserts 142 to be oriented in a vertical, horizontal, or oblique manner. The thinned portions 144, recesses 146, filling materials 140, and inserts 142 of FIGS.

3-17 and 32-35 are illustrated as part of a face 112 of a wood-type golf club 100 as shown in FIGS. 1-2, but in other embodiments, other types of faces (such as the iron-type face 212 in FIGS. 22-23) may be constructed with inserts having the same or similar configurations. Likewise, the thinned portions 144, recesses 146, filling materials 140, and inserts 142 of FIGS. 24-31 are illustrated as part of a face 112 of an iron-type golf club 200 as shown in FIGS. 22-23, but in other embodiments, other types of faces (such as the wood-type face 112 in FIGS. 1-2) may be constructed with inserts having the same or similar configurations. It is understood that these configurations may vary in other embodiments, and that features of any of the embodiments described above may be incorporated into any other embodiments. In addition, it is understood that multiple inserts 142 may be used in connection with any of such other embodiments and configurations, including adding one or more additional inserts 142 to the face 112, 212 in any of the existing configurations in FIGS. 3-17 and 24-35.

The inserts 142 described herein may be permanently connected to the face 112, 212 in some embodiments. In other embodiments, the inserts 142 may be removably connected to the face 112, 212 to enable interchanging of the insert 142 with another insert 142 having different properties, to change the properties of the face 112, 212 as desired. For a club head 102, 202 having a face 112, 212 with interchangeable inserts 140, the weighting, center of gravity, moment of inertia, COR, and/or other properties of the face 112, 212 can be changed by removing the insert 142 and replacing the removed insert 142 with a different insert 142 having one or more different properties. Access to the rear surface 111, 211 of the face 112, 212 may be necessary to interchange the insert 142. When a face 112 is used in connection with a wood-type ball striking device 100 as shown in FIGS. 1-2, the head 102 may include a removable backbody member 129 to provide this access. Several different configurations for removable and/or interchangeable backbody members are shown and described in U.S. patent application Ser. No. 12/192,402, filed Aug. 15, 2008, which is incorporated by reference herein and made part hereof. However, in other embodiments, an insert 142 may be interchangeable from outside the head 112, 212, either from the outer surface 110, 210 of the face 112, 212 or through access to the rear surface 111, 211 without removal of a portion of the body 108, 208. For example, in the head 202 shown in FIGS. 22-23, the rear surface of the face 212 can be accessed from outside the head 202. Additionally, the insert 142 may be insertable and interchangeable in a flowable form, such as by injecting a material into the recess 144 that solidifies or hardens to form the insert 142 and/or removing the insert 142 by heating or otherwise causing the material to flow. One or more holes may be provided in the head 102, 202 for insertion and/or removal of a filling material 140 in flowable form. Other embodiments of ball striking heads may have portions of the head that are removable by other mechanisms and using other structural configurations, and it is understood that such embodiments are included within the scope of the invention.

Although the face 112, 212 is described above as having an insert 142 connected thereto that comprises the filling material 140, the face 112, 212 can alternately be described as being made from at least two different materials, each having different properties, and may or may not utilize inserts to achieve this configuration. For example, the face 112, 212 may be considered as having a thinned portion 144 or recess 146 that contains a second material (e.g. filling material 140). As described above, in one embodiment, the two materials have different densities. The different materials may have additional differing properties as well. Additionally, the face 112, 212 may contain more than two different materials, for example, through the use of multiple inserts, an insert made from multiple materials, or a multi-material face. Any of the inserts 142 described above can be made from multiple materials, which may or may not have different properties. It is understood that in an insert made from multiple materials, different portions of the insert may have different properties (such as different densities). In one embodiment, the density of a multi-material insert can be calculated as the average density of the insert 142 (e.g. total weight or mass divided by total volume). In another embodiment, the relevant density may be the density of a single-material portion of a multi-material insert. Accordingly, in some embodiments of the inserts 142 described above, at least a portion of the insert 142 may have a property (density, stiffness, etc.) that is different from the property of the face 112, 212, and the insert 142 may also have two or more portions with properties that are not only different from each other, but also different from the property of the face 112, 212. Likewise, a portion of the insert 142 may have a different property from the face 112, 212, and another portion may have the same property as the face 112, 212. In other embodiments of single-material or multiple-material inserts 142, the entire insert may have a property that is different from a property of the face 112, 212. As also described above, in one embodiment, the various different materials each form a portion of the rear surface 111, 211 of the face 112, 212.

Club heads 102, 202 incorporating the thinned portions 144, recesses 146, filling materials 140, and/or inserts 142 disclosed herein may be used as a ball striking device or a part thereof. For example, a golf club 100, 200 as shown in FIGS. 1-2 and 22-23 may be manufactured by attaching a shaft or handle 104, 204 to a head that is provided, such as the head 102, 202 as described above. "Providing" the head, as used herein, refers broadly to making an article available or accessible for future actions to be performed on the article, and does not connote that the party providing the article has manufactured, produced, or supplied the article or that the party providing the article has ownership or control of the article. In other embodiments, different types of ball striking devices can be manufactured according to the principles described herein. Manufacturing the head 102 shown in FIGS. 1-2 may include attachment of a backbody member 129 to a face frame member 128, as described above. Additionally, the head 102, 202, golf club 100, 200, or other ball striking device may be fitted or customized for a person by connecting an insert 142 or other filling material 140 having a lower density to customize the weighting and/or other properties of the face 112, 212. Such customization may include selecting an insert 142 or other filling material 140 with specific properties and connecting the insert 142 and/or filling material 140 to the face 112, 212 in an arrangement to achieve the desired weight distribution of the face 112, 212. This customization may also include filling a recess with the filling material 140, which may further include forming the filling material 140 on the rear surface of the face 112, 212 in a desired arrangement. The filling material 140 may be formed from raw components or precursors, such as uncured polymer or composite precursors (using molding techniques, prepreg techniques, etc.). This customization may further include removing a previously-connected insert 142 or other filling material 140 and interchanging it with an alternate insert 142 or other filling material 140 having at least one different property. Multi-material inserts 142 may be interchanged to achieve desired properties such as higher or lower trajectory, more or less spin, etc. Manufacturing and/or customizing the head 102, 202 may also include forming the thinned portion 144 or recess 146 on the face 112, 212. This may be accomplished by any technique, including techniques in the course of forming the face 112, 212, such as molding, stamping, or forging, or post-forming techniques, such as milling or cutting.

Heads 102, 202 incorporating the thinned portions 144, recesses 146, filling materials 140, and/or inserts 142 disclosed herein may be used as part of a kit or assembly that includes a head 102, 202 as described above, along with one or more inserts 142 or other filling material(s) 140 configured for connection to the head 102, 202. If the kit includes multiple inserts 142 or filling materials 140, each of them may have different properties. In one embodiment, the head 102, 202 may have a recess 146 or other thinned portion 144 with a specific shape, and the kit may include one or more inserts 142 having the same shape. In another embodiment, the kit may include inserts 142 having different shapes, and the head 102, 202 may require further processing to connect an insert 142 to the face 112, 212, such as by forming a recess 146 or thinned portion 144 in the face 112, 212. In a further embodiment, the kit may include one or more bulk filling materials 140, or components for creating a filling material 140. The kit may also include one or more shafts 104, 204 for connection to the head. In some embodiments, the kit may include a plurality of inserts 142 that are removable and interchangeable with each other.

The ball striking devices and heads therefor as described herein provide many benefits and advantages over existing products. For example, inserts or other filling materials having various densities and weights can be strategically located and weighted, in connection with recesses or thinned portions of the face, to provide a specific weight distribution of the face. This enables the overall moment of inertia of the head to be changed, such as by adjusting the weight distribution between the center of the face and the edges of the face. This also enables the center of gravity of the face to be moved and/or the relative moment of inertia for various points on the face to be changed, such as by increasing or decreasing the weight of the face in a specific area. Weighting the face in a customized manner can provide superior ball striking for the head, such as by reducing twisting upon impact. Additionally, the weighting can be customized so that the areas of the face that most frequently impact the ball during play will result in greater energy and velocity transfer and truer and straighter ball flight. As another example, inserts having various other properties can be changed using inserts or other filling materials, such as the flexibility, stiffness, and/or COR response of the face, or a portion of the face. Further benefits and advantages are recognized by those skilled in the art.

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

What is claimed is:

1. A wood-type golf club head comprising:

a face having a ball striking surface configured for striking a ball and a rear surface opposite the ball striking surface, with a thickness defined between the rear surface and the ball striking surface, the face having a thinned portion where the thickness is smaller than the thickness of surrounding areas of the face, the thinned portion forming a recess on the rear surface of the face that is recessed relative to the surrounding areas of the face, the recess having a geometric center that is offset from a geometric center of the face;

a body connected to the face and extending rearward from the face to define a cavity bounded by the face and the body; and an insert connected to the rear surface of the face, the insert being received within the recess, wherein the insert comprises a filling material filling the recess, wherein the face is comprised of a second material, and wherein a density of the filling material is lower than a density of the second material, and wherein a geometric center of the insert is offset from the geometric center of the face, and the lower density of the insert causes a center of gravity of the face to be offset from the geometric center of the face in a direction away from the geometric center of the insert.

2. The golf club head of claim 1, wherein the insert is substantially flush with the rear surface of the face.

3. The golf club head of claim 1, wherein the insert has a thickness and the recess has a depth that are tapered such that the thickness of the insert and the depth of the recess increase toward an outer edge of the face.

4. The golf club head of claim 3, wherein the thickness of the insert and the depth of the recess are tapered in two directions, such that the thickness of the insert and the depth of the recess increase in a vertical direction toward a top edge of the face and the thickness of the insert and the depth of the recess decrease in a horizontal direction toward a lateral edge of the face.

5. The golf club head of claim 1, wherein the insert has a width and the recess has a width that are tapered such that the width of the insert and the width of the recess increase toward an outer edge of the face.

6. The golf club head of claim 1, wherein the filling material has a higher flexibility than the second material, and a first area of the ball striking surface of the face overlapping the insert has a higher COR than a second area of the face that does not overlap the insert.

7. The golf club head of claim 1, wherein the face and the body enclose a volume of at least 400 cubic centimeters.

8. A wood-type golf club comprising the golf club head of claim 1 and a shaft connected to the golf club head.

9. An iron-type golf club head comprising:

an iron-type golf club body comprising a sole and a face extending upward from the sole, the face having a ball striking surface configured for striking a ball and a rear surface opposite the ball striking surface, with a thickness defined between the rear surface and the ball striking surface, the face further having a thinned portion where the thickness is smaller than the thickness of surrounding areas of the face, the thinned portion forming a recess on the rear surface of the face that is recessed relative to the surrounding areas of the face, the recess having a geometric center that is offset from a geometric center of the face; and an insert connected to the rear surface of the face, the insert being received within the recess, wherein the insert comprises a filling material filling the recess, wherein the face is comprised of a second material, and wherein a density of the filling material is lower than a density of the second material, and wherein a geometric center of the insert is offset from the geometric center of the face, and the lower density of the insert causes a center of gravity of the face to be offset from the geometric center of the face in a direction away from the geometric center of the insert.

10. The golf club head of claim 9, wherein the insert is substantially flush with the rear surface of the face.

11. The golf club head of claim 9, wherein the insert has a thickness and the recess has a depth that are tapered such that the thickness of the insert and the depth of the recess increase toward an outer edge of the face.

12. The golf club head of claim 9, wherein the filling material has a higher flexibility than the second material, and a first area of the ball striking surface of the face overlapping the insert has a higher COR than a second area of the face that does not overlap the insert.

13. An iron-type golf club comprising the golf club head of claim 9 and a shaft connected to the golf club head.

14. A golf club head comprising:

a face having a ball striking surface configured for striking a ball and a rear surface opposite the ball striking surface, the rear surface having a recess, the recess having a geometric center that is offset from a geometric center of the face;

a body connected to the face; and an insert connected to the face and having a geometric center that is offset from the geometric center of the face, the insert being received within the recess, wherein the insert comprises a polymer filling material filling the recess, wherein the filling material has a density that is lower than a density of a metallic material of the face, and wherein the lower density of the insert causes a center of gravity of the face to be offset from the geometric center of the face in a direction away from the geometric center of the insert.

15. The golf club head of claim 14, wherein the insert is made of a composite material comprising the polymer filling material and a fiber.

16. The golf club head of claim 14, wherein the insert is substantially flush with the rear surface of the face.

17. The golf club head of claim 14, wherein the recess has a depth that is tapered such that the depth of the recess increases toward an outer edge of the face.

18. The golf club head of claim 17, wherein the depth of the recess is tapered in two directions, such that the depth of the recess increases in a vertical direction toward a top edge of the face and the depth of the recess decreases in a horizontal direction toward a lateral edge of the face.

19. The golf club head of claim 14, wherein the recess has a width that is tapered such that the width of the recess increases toward an outer edge of the face.

* * * * *